US008540653B2

(12) United States Patent
Baldauf et al.

(10) Patent No.: US 8,540,653 B2
(45) Date of Patent: Sep. 24, 2013

(54) APPARATUS FOR MECHANICALLY VENTILATING A PATIENT

(75) Inventors: Mary Baldauf, Valley Stream, NY (US); Thomas Baldauf, Merrick, NY (US)

(73) Assignee: Baldy By Design, LLC., Valley Stream, NY (US)

( * ) Notice: Subject to any disclaimer, the term of this patent is extended or adjusted under 35 U.S.C. 154(b) by 1616 days.

(21) Appl. No.: 11/597,844

(22) PCT Filed: May 27, 2005

(86) PCT No.: PCT/US2005/018799

§ 371 (c)(1), (2), (4) Date: Sep. 10, 2007

(87) PCT Pub. No.: WO2005/117800

PCT Pub. Date: Dec. 15, 2005

(65) Prior Publication Data

US 2008/0167586 A1 Jul. 10, 2008

(51) Int. Cl.
*A61H 31/00* (2006.01)

(52) U.S. Cl.
USPC ..... 601/43; 601/11; 601/44

(58) Field of Classification Search
USPC ..... 601/6–11, 41–44; 128/202.12, 205.26
See application file for complete search history.

(56) References Cited

U.S. PATENT DOCUMENTS

| | | | | | |
|---|---|---|---|---|---|
| 2,263,844 | A | * | 11/1941 | Hammond | 601/43 |
| 2,309,361 | A | | 1/1943 | Terhaar | |
| 2,333,231 | A | * | 11/1943 | Berg | 607/83 |
| 2,385,683 | A | * | 9/1945 | Burton | 601/11 |
| 2,816,540 | A | * | 12/1957 | Haverland | 601/43 |
| 2,822,803 | A | * | 2/1958 | Huxley, III et al. | 601/43 |
| 3,078,842 | A | | 2/1963 | Gray | |
| 3,490,443 | A | * | 1/1970 | Decupper | 601/11 |
| 3,862,622 | A | | 1/1975 | Spinnett | |
| 4,003,378 | A | * | 1/1977 | Pickering | 128/205.17 |
| 4,038,806 | A | | 8/1977 | Rothman et al. | |
| 4,221,211 | A | * | 9/1980 | Brasch | 600/22 |
| 4,257,407 | A | | 3/1981 | Macchi | |
| 4,294,464 | A | | 10/1981 | Ettridge | |
| 4,523,579 | A | * | 6/1985 | Barry | 601/44 |
| 4,761,853 | A | | 8/1988 | Hoffman | |
| 4,815,452 | A | * | 3/1989 | Hayek | 601/44 |
| 4,926,844 | A | * | 5/1990 | Lindley | 601/43 |
| 5,222,478 | A | | 6/1993 | Scarberry et al. | |
| 5,261,779 | A | | 11/1993 | Goodrich | |
| 5,490,820 | A | | 2/1996 | Schock et al. | |
| 5,573,498 | A | | 11/1996 | Hayek | |
| 6,461,315 | B1 | | 10/2002 | Gattinoni | |
| 6,497,231 | B1 | | 12/2002 | White | |
| 2004/0030272 | A1 | | 2/2004 | Kelly et al. | |
| 2004/0079506 | A1 | | 4/2004 | Mohrsen et al. | |

* cited by examiner

*Primary Examiner* — Quang D Thanh
(74) *Attorney, Agent, or Firm* — Dilworth & Barrese, LLP.

(57) ABSTRACT

An apparatus for mechanically ventilating a patient is provided to have two separate components movably arranged with respect to one another within a flexible, air-tight covering fit about the torso of a patient. When the components move away from one another within the air-tight covering, negative pressure is generated which causes the patient to draw air into the lungs. Conversely, when the components stop moving away from one another within the air-tight covering, the patient's natural exhalation recoil takes over to allow the patient to expel the air from within the patient's lungs. A ventilator for helping a patient such as a premature infant breathe when placed in a chamber, is also provided.

20 Claims, 25 Drawing Sheets

APPARATUS FOR MECHANICALLY VENTILATING A PATIENT

This application is a 371 of PCT/US2005/18799 filed on May 27, 2005

BACKGROUND OF THE INVENTION

The present invention is directed to a physical apparatus used to assist mechanically ventilating a patient. More specifically, the present invention provides non-invasive pressure changes outside a patient's chest wall, allowing mechanical ventilation without need for invasive endotracheal, orotracheal or tracheal intubation.

Under normal physiological conditions, humans breathe using "negative pressure ventilation." In other words, a negative intrathoracic pressure is created by contraction of the intercostal muscles (between the ribs), upward and outward expansion of the ribs, and downward movement of the muscular diaphragm separating the thorax from the abdomen. All these changes act to expand both lungs and thus create a negative intrathoracic pressure. The pressure change enables gas to move from the outside atmosphere, through the human air passages, and into the deepest areas of the human lung. The natural tendency of the lungs to constrict similarly to a stretched rubber band, (elastic recoil), creates an inward intrathoracic pull, such that, as soon as the intercostal muscles relax, the ribs are pulled inward and downward, and the muscular diaphragm is pulled upward. These movements create a positive intrathoracic pressure, relative to the outside atmospheric pressure, thus forcing the gas out of the lungs through the human air passages, and back into the atmosphere.

By drawing on the natural biomechanics of human breathing, the present invention very closely simulates human respiratory mechanics and aids neonatal, pediatric and adult patients who require respiratory support or assistance.

Many different machines have been designed to deliver gas into the lungs by creating positive pressure outside the airways, and thereby forcing gas into the patient's airways. These machines provide lifesaving benefit, but are not without risks. For example, most "positive pressure ventilators" force gas through a small, artificial tube placed within the patient's trachea or airway, termed "invasive positive pressure ventilation," because the patient's airway is penetrated or invaded by the artificial tube. Use of such a tube carries complications such as difficulty in proper placement, risks of dislodging, clogging, or causing infection. Additionally, the force with which each breath is delivered to the patient can lead to trauma to the lung tissue itself, including lung rupture or collapse.

More recently, "noninvasive positive pressure ventilation" has begun being practiced, which involves using a mask outside a patient's nose or mouth to deliver the positive pressure into the lungs. This greatly reduces the risks of improper placement, dislodging or clogging of the mask, and virtually eliminates the risk of severe infection due to contamination of equipment. However, such form of mechanical ventilation functions less than ideally because the gas cannot be directed solely into the lungs, but is rather forced into the back of the throat where the gas travels to both the lungs and stomach, the relative proportions of gas depending on the resistance of each pathway. Furthermore, several noninvasive positive pressure ventilators require the patient to remain confined to bed (e.g., Nasal Continuous Positive Airway Pressure (NCPAP) or Bilevel Positive Airway Pressure (BiPAP)), while others might allow the patient to sit up or be pushed in a wheelchair, but do not permit full mobility.

Negative pressure ventilators, e.g., iron lungs, are known in which a patient's body rests entirely within the chamber with only the patient's head protruding through a portal situated around the patient's neck. More recently, negative pressure ventilator "shells" have been developed that encompass only the patient's thorax and abdomen. For infants, negative pressure chambers are designed to house the entire body (excluding the head). Both the "shells" and chambers must be attached to a separate pressure ventilator via vacuum hose in order to function. However, such conventional chambers or ventilators suffer several disadvantages. For example, there is difficulty in observing a patient from all angles, with it also being cumbersome to access the patient through a door to the chamber. A great deal of space is required to permit the door to rest safely and securely on top of the ventilator chamber, when opened. Placement of the handle for the front access door to the ventilator chamber has resulted in confusion with locking mechanism for creation of the airtight seal of the access door. This could result in breaking of the access door handle and/or inadequate closure of the front shield and seal formation.

Difficulty has been encountered in including the patient's upper airway within the negative pressure chamber. Thus, the upper airway of a patient could be in danger of collapse during creation of the vacuum to assist the patient's breathing. Difficulty in accessing the interior of the chamber, e.g., during nonoperation, has made it difficult to easily clean and launder material in contact with the patient, e.g., an infant. Although ventilator chambers have been free-standing on the ground, a separate base or foundation has been required for practical functioning. Thus, an institution such as a hospital must provide such support for the chamber, while such support might not meet standards required by the Food and Drug Administration.

Difficulty has been encountered in providing an adequate seal around the patient's neck, especially in a small infant, resulting in a high percentage of vacuum leaks occurring at low vacuum pressure. This could activate alarms on the ventilator itself, forcing an operator to frequently stop and reset the ventilator at low pressures. Difficulty in monitoring and maintaining temperature and humidity inside the ventilator chamber has also been encountered.

Additional problems encountered with such ventilators include the need to stop and restart if a seal is broken for longer than an allotted period of time. Once seals have been well-established and the ventilator activated, it generally takes 20-30 seconds (based upon a breath rate of 20 breaths per minute and pressure −7 cm $H_20$) to achieve the desired negative pressure. Providing sufficient staff to maintain such ventilators has also been difficult, while replacement parts were not readily available. As a result, lead time in clinical operation of such a ventilator after initial installation is often more than one month.

Developing the ability to utilize "noninvasive negative pressure ventilation" can eliminate many of the risks of the positive pressure ventilators.

Accordingly, it is an object of the present invention to improve effective and safe use of noninvasive negative pressure ventilation in assisting mechanical ventilation of a patient.

It is a more particular object of the present invention to provide a self-contained, noninvasive negative pressure mechanical ventilator created in the form of an air-tight covering about a patient's torso that will permit full mobility and comfort of the patient.

It is a further object of the present invention to improve respiratory mechanics and mobility, and thereby improve quality of life of patients requiring mechanical ventilation.

SUMMARY OF THE INVENTION

These and other objects are attained by the present invention which is directed to an apparatus for mechanically ventilating a patient, comprising two separate, substantially rigid components structured and arranged to be movably coupled with respect to one another, and a flexible, air-tight covering (e.g., a vest) structured and arranged to cover both components when placed about a torso of a patient. When the components move away from one another within the air-tight covering, negative pressure is generated within the covering and causes the patient to draw air into the expanding lung cavity. The only active part of the vest is the creation of negative intrathoracic pressure by moving the front and back plates away from each other within the air-tight vest.

The mechanism that moves the plates away from each other will be timed such that it will release itself (for example, a pneumatic actuator is spring-loaded and has a one-way release valve to let go of the compressed air and thus allow the pin of the actuator to return and re-set itself for the next inhalation).

What causes the patient to exhale is the same mechanism by which every other person exhales, whether spontaneously breathing without a machine, invasive positive pressure breathing, or negative pressure breathing that is the natural elastic recoil of the lungs themselves.

Similar to stretching giant rubberbands, effort is only required to expand the lungs (to inhale); once the lungs stop expanding, then they will naturally recoil (thereby creating positive intrathoracic pressure and forcing air from inside the lungs and airways to outside the airways). Moving the plates closer to each other does not cause the patient to exhale, in and of itself.

The negative pressure ventilator vest allows the patient's own natural lung mechanics to control the exhalation (thus aiding the patient's respirations, while operating closely to mimic a patient's own natural, spontaneous respiratory efforts).

The one-way air-release valve(s) built into the air-tight vest allow for quick-release of any air trapped underneath the vest during inhalation (namely from the area around the neck of the vest, which cannot realistically be completely air impenetrable due to concerns of patient safety and comfort).

Exhalation due to elastic recoil occurs very quickly so trapped air underneath the vest should not impede this process. The release valve(s) are placed in the material of the vest to quickly release trapped air in preparation for the next inhalation.

Preferably, means for movably coupling the substantially rigid components together are provided within the air-tight covering. This means can take the form of a pantograph linkage, a U or horseshoe, or a pincer. More particularly, the components are formed as two separate, light-weight, concave, rigid half-shells positioned on the front and back of a patient's torso, adjacent the chest cavity. Each component is positioned with the concave side toward the torso and held in place with soft straps placed across the patient's shoulders. Additional straps may be placed around the waist, if desired. These separate shells can be formed from any lightweight material that will maintain shape, e.g., fiberglass, plastic or plaster, and may be formed of several layers adhering together, e.g., as a laminate.

The straps can be formed from cotton, cloth, leather, or any other appropriate material, and can be fastened together with Velcro®, hooks or ties. Different size shells can easily be provided in accordance with the present invention.

About one to three pneumatic actuators will be attached to the anterior and posterior shells on each side of the patient, depending on desired negative pressure generation for each patient. These actuators are activated by a pneumatic system along the lateral edge of the outer covering or vest, thus eliminating the need for electrical or battery-generated power. The pneumatic actuators can be powered in any of the following ways. Firstly, compressed gas tubes can be provided with timed release-valves to periodically force the pin outwardly from the actuator. When the valve is cycled to the "off" position, the compressed gas is no longer directed to the actuator and the spring-loaded mechanism then pulls the pin of the actuator back inwardly. The air previously inside the barrel of the actuator is simultaneously released via a one-way valve built into the actuator. Alternatively, electrically and/or battery operated compressors that convert atmospheric gas into compressed gas and then time-cycle the compressed gas into the actuator in the same manner, could be used in the context of the present invention.

The air pressure, stroke length, and exerted force of the actuators are adjustable, allowing for operator control of the patient-specific ventilator breath rates, tidal volume generation, and inspiratory time. The stroke of the actuator will automatically adjust based on anterior and posterior resistance to movement, thus allowing the anterior and posterior shells to move equally when the patient is standing, and the non-dependent shell to move twice as far when the dependent shell is immobile, when the patient is lying down (either prone or supine).

The anterior and posterior shells, as well as the pneumatic actuators attached to the lateral edges, will all be covered by the air-tight, rubberized, short-sleeved shirt or covering, with tight fasteners around both sleeves and the waist area. The neck area will also be made of air-tight material, but not fastened as tightly. The shirt or vest will have several one-way air-release valves that will contain air during expansion of the shells, yet allow for quick escape of air during the period of patient exhalation when the shells are moving toward each other.

The inventive vest will sit comparatively or substantially air-tightly about the upper torso of a patient. In other words, there will be some slight seepage of air into the vest through, e.g., the collar about a patient's neck. However, the one-way air release valve permits expelling of this seepage upon the patient's exhalation.

The actuators utilize pneumatic pressure to push apart the anterior and posterior shells from each other. When this operation is performed inside the rubberized, air-tight shirt, a negative pressure is generated within the shirt that, in turn, pulls the walls of the patient's chest upward and outward. This results in negative intrathoracic pressure, which then causes the patient to draw air from the higher pressure atmosphere into the lungs through the patient's airways. The actuators are set to allow time for the shells to come together during the natural "elastic recoil" phase of normal human exhalation. During this phase, the one-way valves allow air to exit from inside the air-tight covering, thereby readying the apparatus for the next inhalation cycle. Alternatively, the anterior and posterior components or shells can be movably coupled by a mechanism situated externally of the rubberized shirt or vest.

The inventive apparatus thereby simulates normal, physiologic breathing, eliminating the need for artificial airway maintenance and allowing each patient to achieve full mobility and thereby, normal existence.

The present invention is also directed to a ventilator which helps a patient such as a premature infant suffering pulmonary disability to breathe on their own. The inventive ventilator is easy to assemble and use, and effective in use, being of special advantage to aid premature infants in breathing.

BRIEF DESCRIPTION OF THE DRAWINGS

The present invention will be described in greater detail with reference to the accompanying drawings, in which.

DESCRIPTION OF THE PREFERRED EMBODIMENTS

Figures 1, 1A:
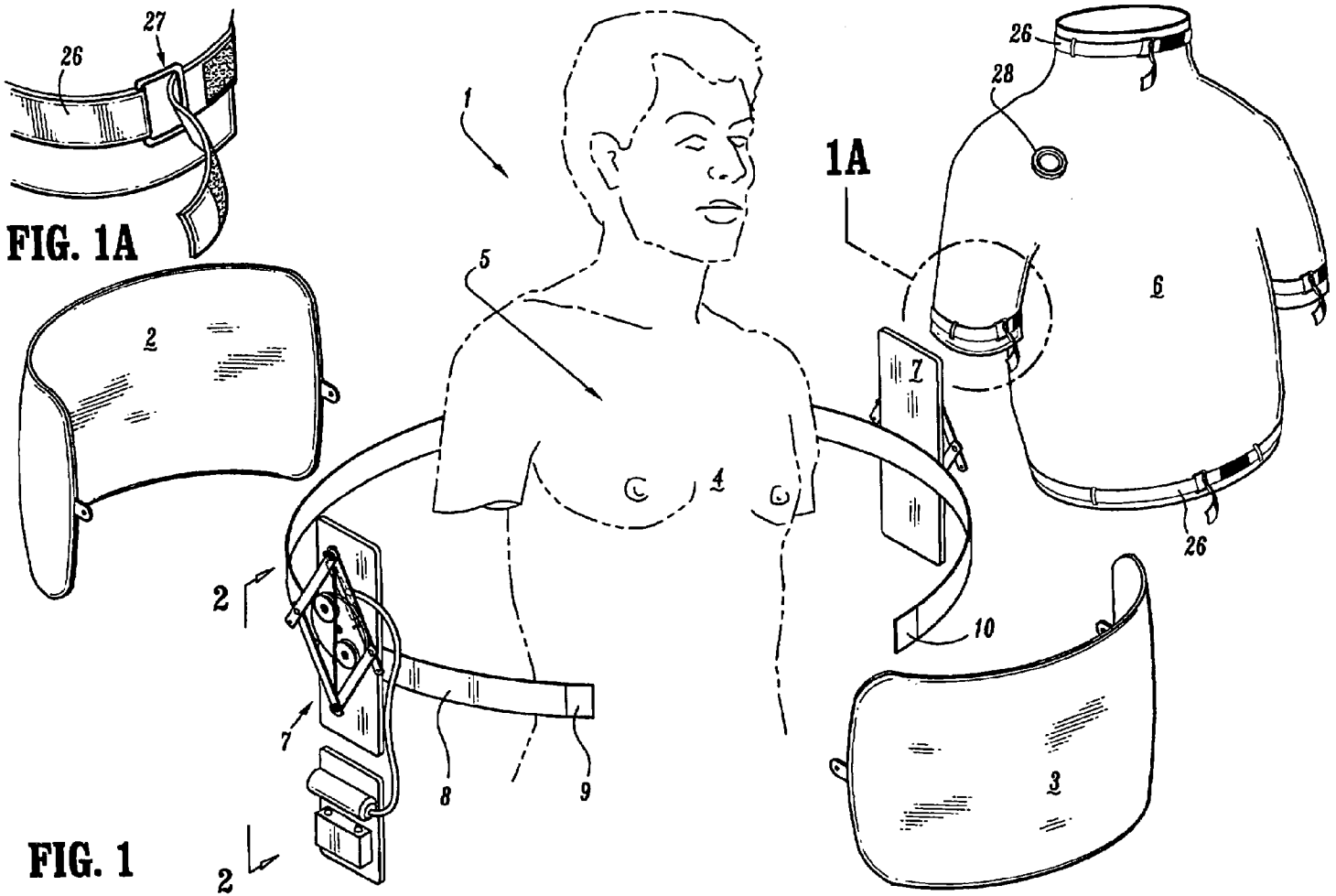
FIG. 1 is a schematic, exploded view of the inventive apparatus.
FIG. 1A is an enlarged view of encircled area 1A in FIG. 1.

Referring to the drawings in which analogous components are denoted by analogous reference numerals or characters, the inventive apparatus 1 for mechanically ventilating a patient has two components 2 and 3 arranged to reciprocally move towards and away from one another. These components are positioned about the torso 4 of a patient, i.e., the chest cavity 5, and secured within an outer elastic shell 6, e.g., a vest or shirt, which can be formed of any suitable material such as spandex, polyester, etc. A preferred elastic garment that functions especially well as an air-tight elastic shell 6 in accordance with the present invention is a Nike Dri-Fit short sleeve shirt composed of 82% polyester and 18% spandex. This shirt was coated on the outer surface thereof with a thin layer of General Electric clear Silicone II 100% Window and Door silicone sealant, manufactured by GE Sealants and Adhesives, Huntersville, N.C. 28078, to enhance air-tightness.

The movable components 2 and 3 themselves can be manufactured from any suitable material, e.g., fiberglass, lightweight plaster, or synthetic plastic such as polyethylene terephthalate, polyvinyl chloride, etc. An especially preferred material is hardened fiberglass created using a Bondo Home Solutions fiberglass mat manufactured by the Bondo Corporation (an RPM Company), 3700 Atlanta Industrial Parkway, N.W., Atlanta, Ga. 30331 and treated with Everciat (100498) automotive fiberglass resin and hardener, manufactured by Fibre Glass-Evercoat, a division of Illinois Tool Works, Inc. 660 Cornell Road, Cincinnati, Ohio 45242.

The flexible air-tight covering 6 is placed about the torso 4 of the patient, i.e., around the chest cavity 5, after the substantially rigid components 2 and 3 have been movably positioned about the torso 4 and chest cavity. Thereby, when components 2 and 3 move away from one another within the air-tight covering 6, negative pressure is generated within the air-tight covering 6 and influences the torso 4 and chest cavity 5 of the patient to cause the patient to draw air into the patient's lungs. Conversely, when the components 2 and 3 stop moving apart within the air-tight shell 6, the patient's natural exhalation mechanism takes over, allowing the patient to expel the air from within the patient's lungs.

Figure 2:
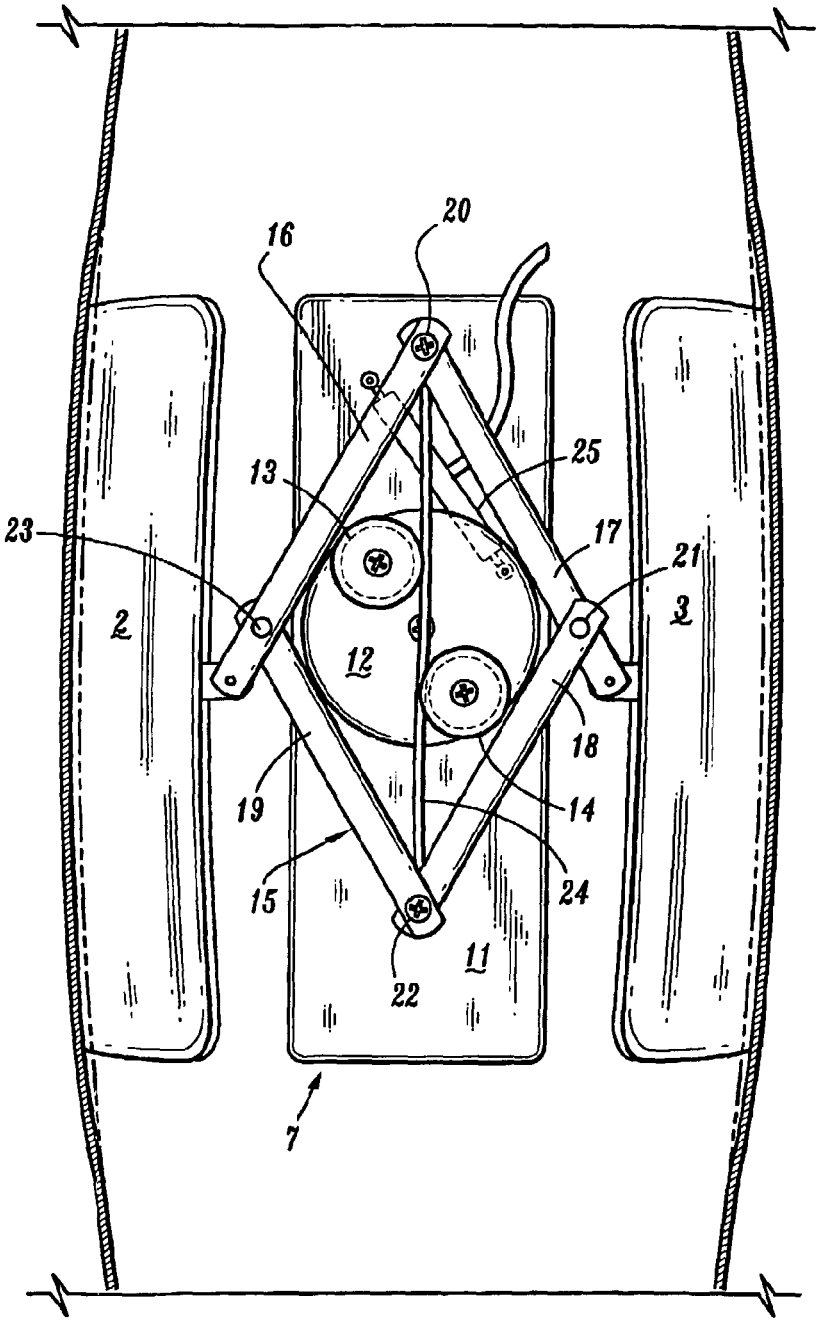
FIG. 2 is a plan view of a portion of the inventive apparatus from the direction of arrow 2 in FIG. 1.

As shown in FIG. 1, the inventive apparatus 1 comprises means 7 for movably coupling components 2 and 3 together such that they can reciprocally move towards and away from each other. This coupling means 7 can be mounted upon an elastic band 8 which is then secured around the patient's torso 4, e.g., by Velcro sections 9 and 10 at ends thereof. As best seen in FIG. 2, the coupling means 7 comprise a support 11 mounted upon the band 8, with a turntable 12 rotatably positioned upon the support 11 and, in turn, having two substantially cylindrical stops 13 and 14 mounted thereon. The two movable components 2 and 3 are coupled together through a pantograph linkage 15 taking the shape of a parallelogram in FIG. 2 comprising four links or sides 16, 17, 18, 19 rotatably coupled together about four respective pivot points 20, 21, 22, 23. As shown in FIG. 2, the components 2 and 3 are coupled to extensions of respective links 16 and 17 however the components can alternatively be coupled directly to the pivot points 21 and 23 within the purview of the present invention.

Figure 3:
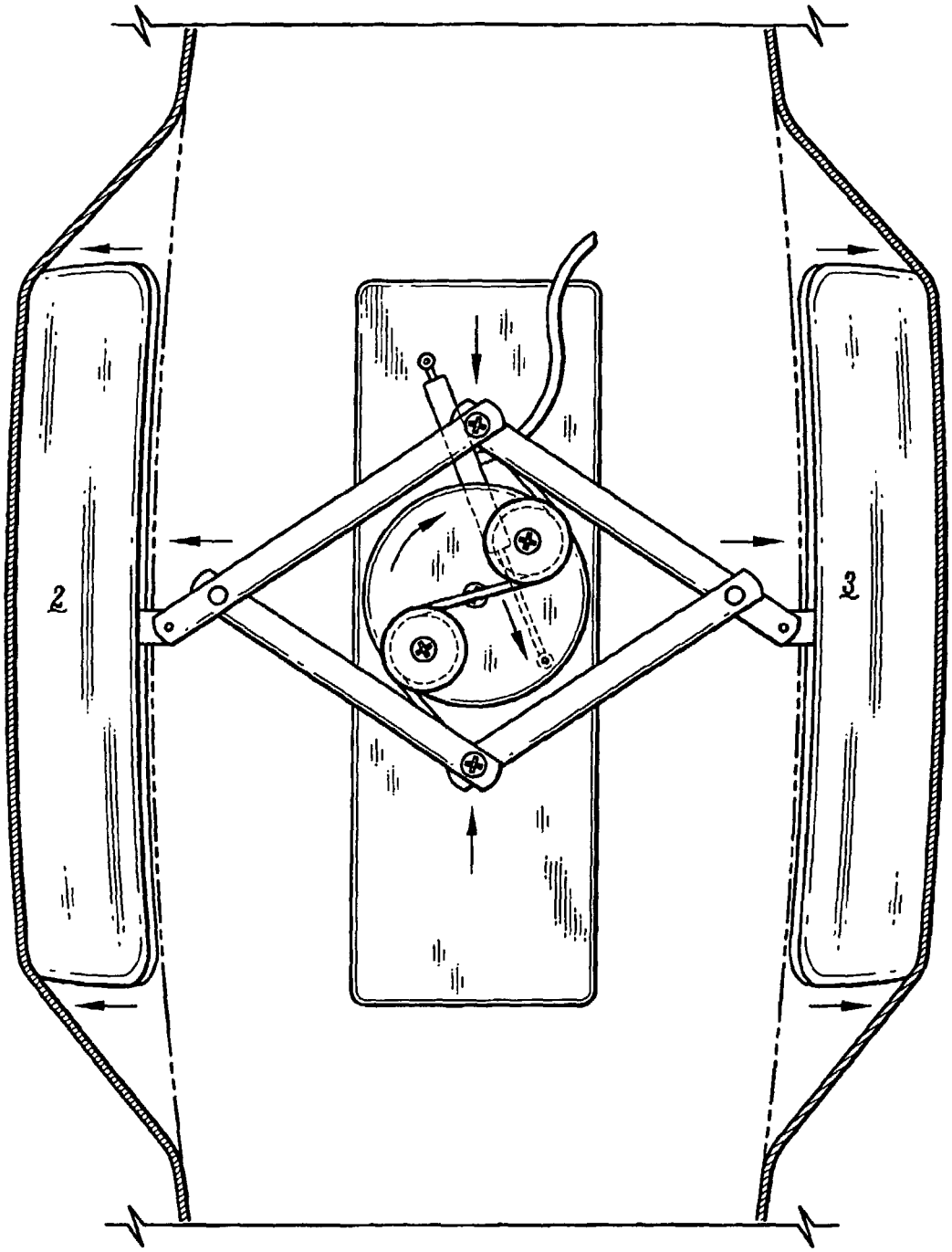
FIG. 3 is a plan view, similar to FIG. 2, and illustrating an oppositely-biased position of the inventive apparatus from the position shown in FIG. 2.

An untensioned member 24 is also mounted to the parallelogram linkage 15 to extend between two opposite pivot points 20 and 22 and straight between the stops 13 and 14 mounted upon the turntable, in unstressed state as shown in FIG. 2. Additionally, a pneumatic actuator 25 is coupled between the support 11 and turntable 12 as shown in FIGS. 2 and 3. When the pneumatic actuator rotates the turntable 12 with respect to the support 11 in a clockwise direction from FIG. 2 to FIG. 3, the space between the components 2 and 3 expands due to expansion of the pantograph linkage 15 and a negative pressure is generated within the elastic shell 6. At the same time, the member 24 is tensioned and twisted about the two stops 13 and 14 which rotate together with the turntable 12 as shown in FIG. 3, thereby enhancing a force biasing the parallelogram linkage to return to its untensioned state shown in FIG. 2.

Therefore, when pneumatic actuator 25 has expanded to maximum extension as shown, e.g., by the phantom lines in FIG. 3, the return biasing action of a spring within the pneumatic actuator 25 takes over to return the linkage to the unstressed state shown in FIG. 2, whereupon the pneumatic actuator retracts to initial position and once again begins the next cycle of expansion. Then, the elastic recoil of the patient's lungs causes spontaneous exhalation once the compressed air is no longer extending the pin of the actuator. This returns the linkage to the unstressed state in preparation for the next cycle of expansion.

Two such coupling means 7 have been illustrated in FIG. 1 although the inventive apparatus will effectively operate with just one such coupling mechanism as shown in FIGS. 2 and 3 and with the components coupled on opposite sides, e.g., by just a driven pantograph linkage. Although the embodiment illustrated in FIG. 1 shows the coupling means positioned within the outer shell 6, nevertheless such coupling means could easily be positioned outside the air-tight covering 6 and appropriately coupled to the components 2 and 3 within the covering 6 through openings provided in the covering 6. As denoted by the dotted lines in FIG. 1, the band 8 is initially positioned about the torso 4 of a patient. The support member 11 of the coupling means is conveniently secured to the band 8 either before or after the band 8 is positioned about the torso 4 of a patient.

Next, the components 2 and 3 are secured to respective extensions of the pantograph linkages 15, followed by positioning of the air-tight covering 6 securely about the torso of the patient, including the chest cavity. The neck, waist, and sleeve openings of the covering 6 are sealed by respective straps 26 and buckles 27 as shown in detail in FIG. 1A, to provide a secure air-tight enclosure within the covering 6. Additionally, a one-way check valve 28 is provided in the covering 6 to release air from within the sealed covering 6 and avoid undue build-up of air pressure therewithin.

Figure 4:
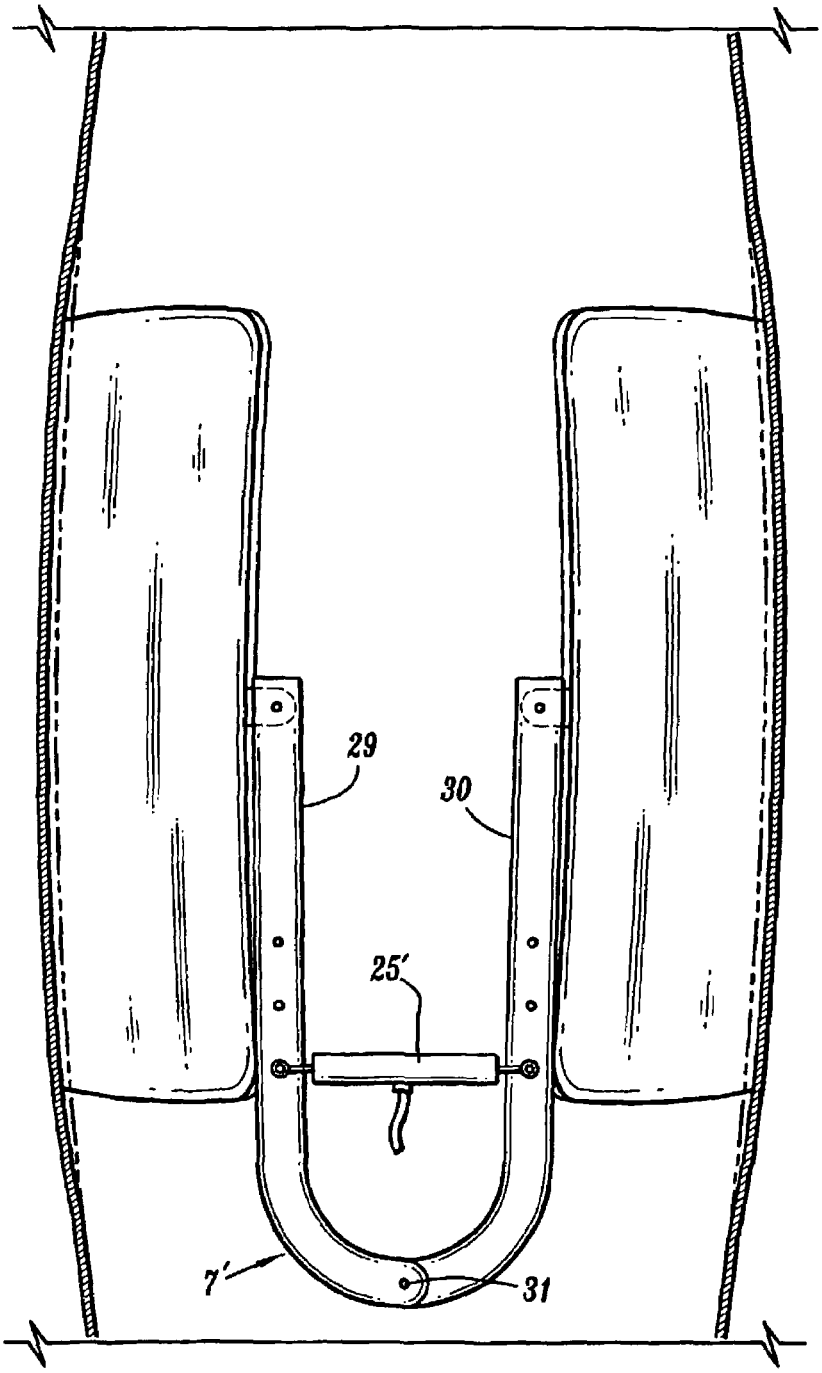
FIG. 4 is a plan view, similar to FIG. 2 and illustrating an alternative embodiment of the inventive apparatus.
Figure 5:
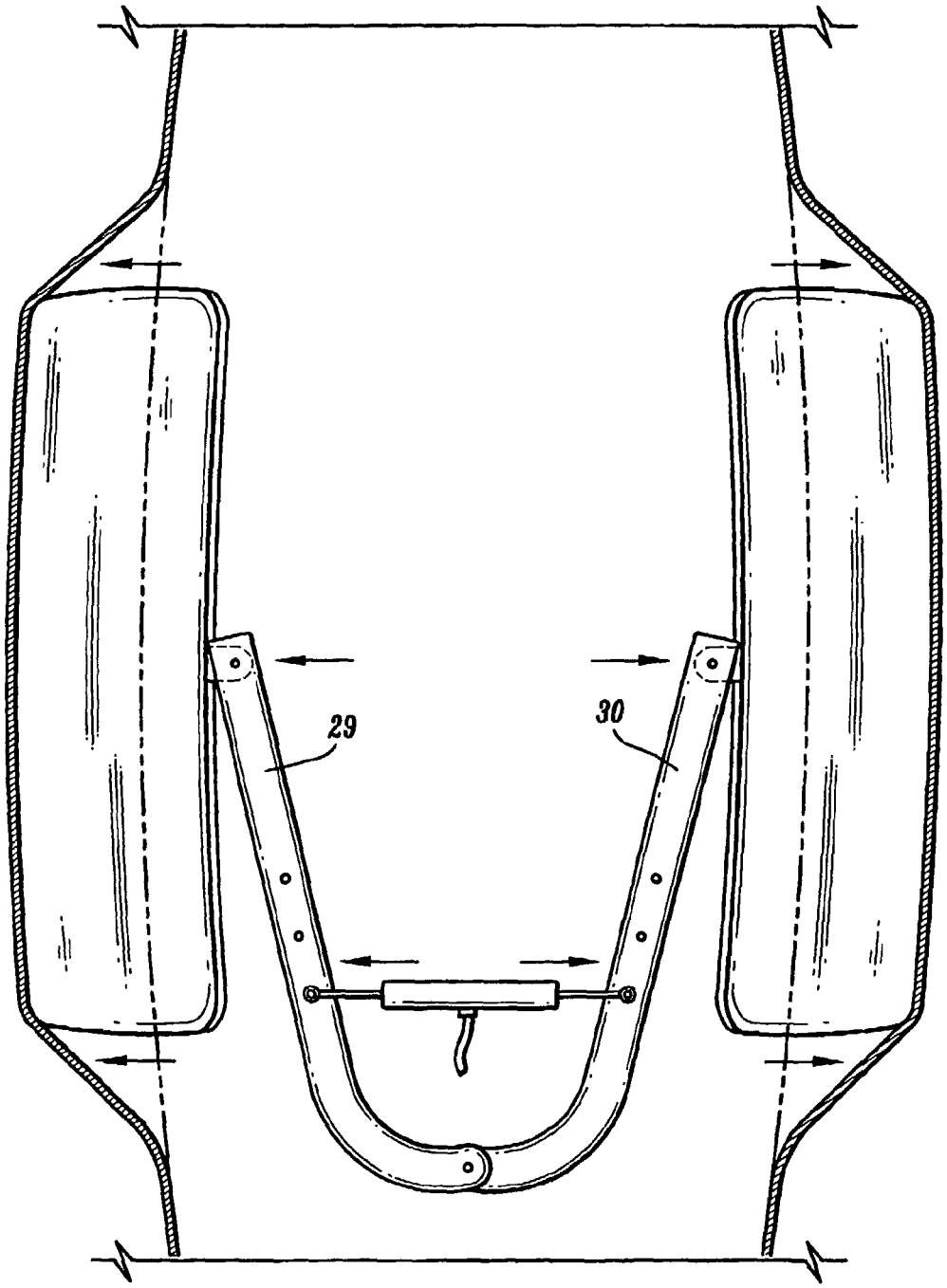
FIG. 5 is a plan view, similar to FIG. 3, and illustrating an oppositely-biased position of the inventive apparatus from the position shown in FIG. 4.

FIGS. 4 and 5 illustrate and alternative embodiment of the coupling means 7' which dispenses with the support plate 11 and turntable 12. More particularly, in this embodiment, the coupling means 7' comprises two members 29 and 30 forming a linkage substantially in the shape of a U or horseshoe and pivotally coupled together at a pivot point 31 situated substantially at the base of the U or horseshoe. A respective movable component 2 and 3 is coupled to a respective pivotal member 29 and 30. A pneumatic actuator 25' is provided similarly to the embodiment shown in FIGS. 2 and 3 but with the actuator 25' laterally coupled to the pivotal members 29 and 30 above the pivot point 31 as shown. Additionally, means (not shown) for biasing the pivotal members 29 and 30 towards the position shown in FIG. 4, e.g., a coil spring, can be provided. The remaining components of the inventive device are the same as shown in FIGS. 1-3.

The pneumatic actuator 25' operates to push the pivotal members 29 and 30 apart from one another to the position shown in FIG. 5 where the components 2 and 3 are also moved apart, hence creating the negative pressure within the air-tight covering 6. When the pneumatic actuator 25' reaches the point of maximum extension shown in FIG. 5, then the spring action within the pneumatic actuator takes over and biases the pivotal arms 29 and 30 back to the closer position shown in FIG. 4 where the cycle begins once again.

Figure 6:
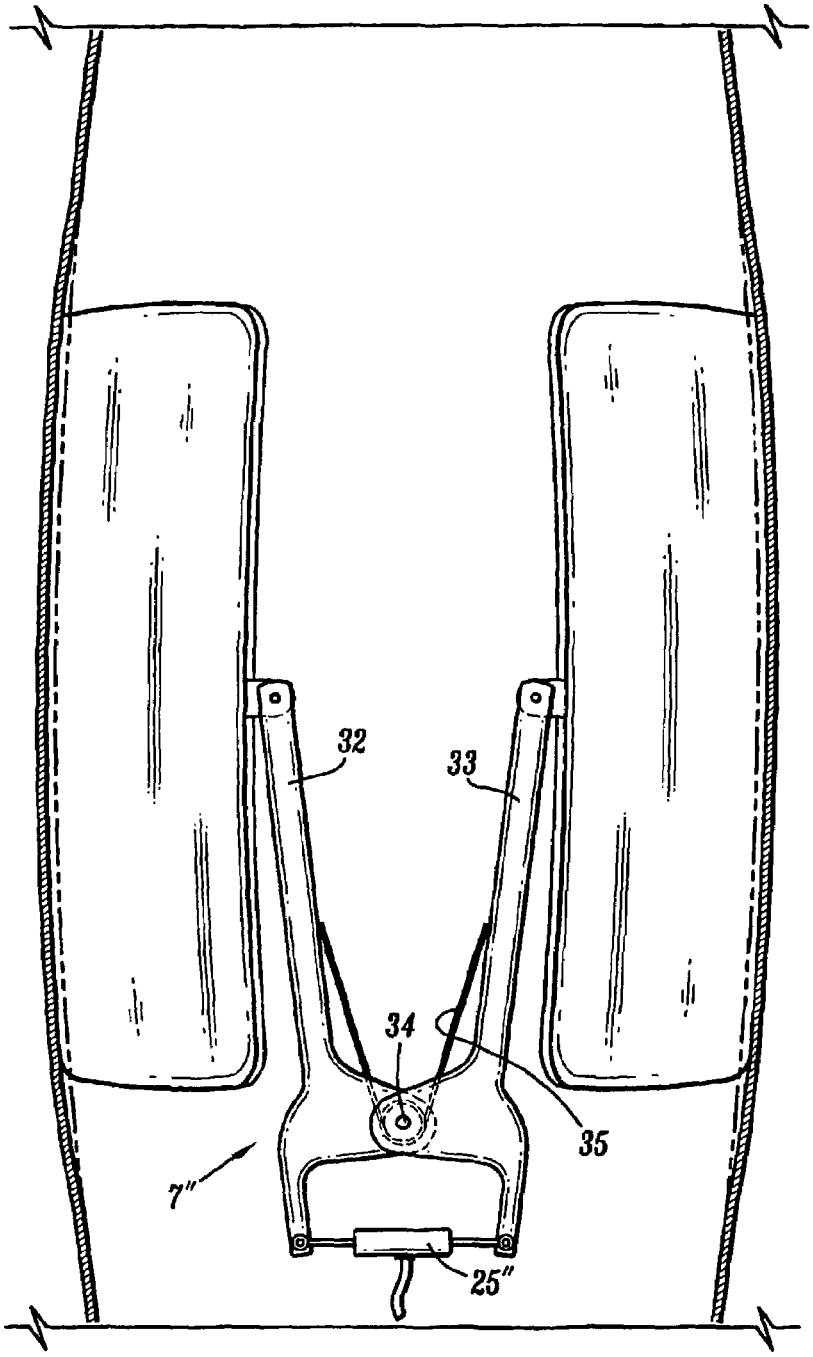
FIG. 6 is a plan view, similar to FIGS. 2 and 4, and illustrating another alternative embodiment of the inventive apparatus.
Figure 7:
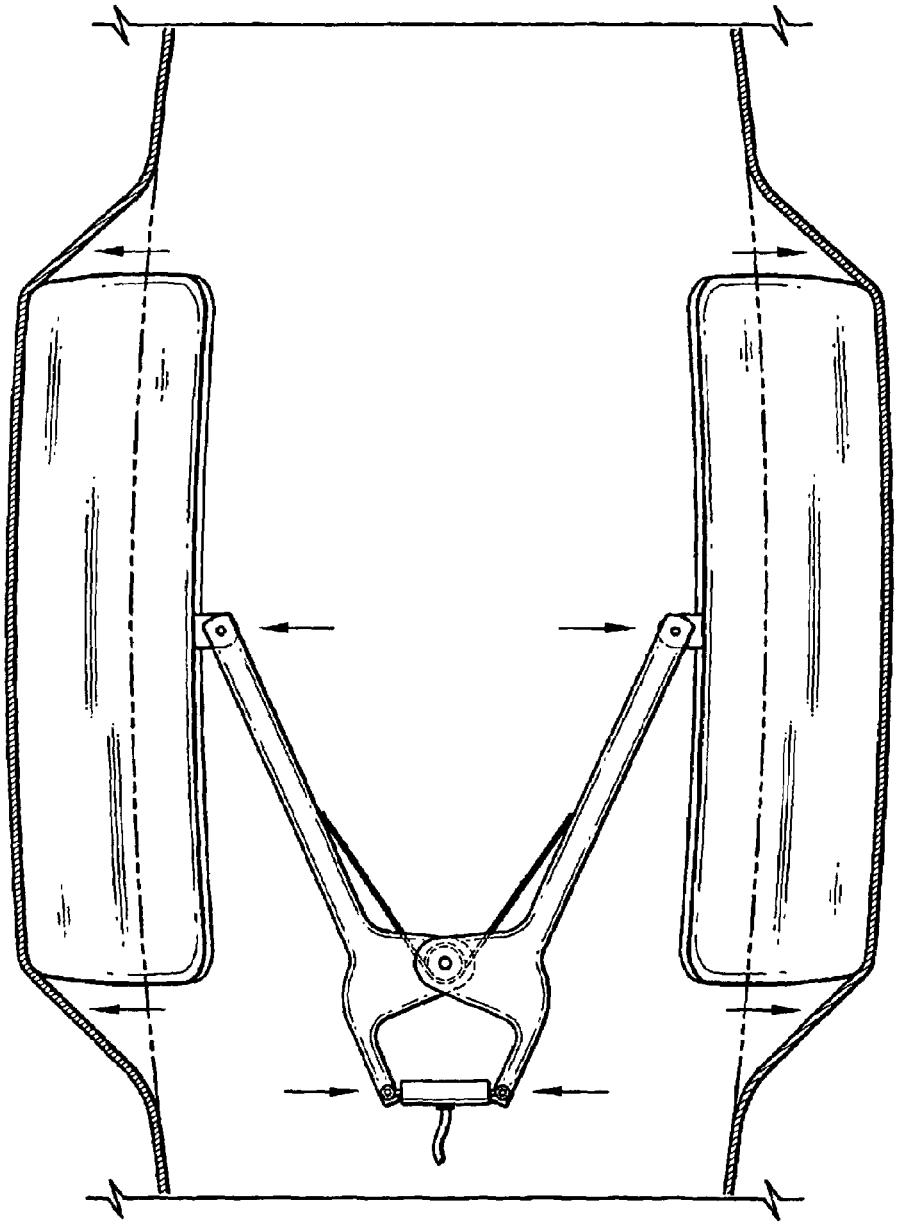
FIG. 7 is a plan view, similar to FIGS. 3 and 5, and illustrating an oppositely-biased position of the inventive apparatus from the position shown in FIG. 6.

FIGS. 6 and 7 illustrate a further alternative embodiment of the coupling means 7" in the shape of a pincer, having two arms 32 and 33 coupled together about pivot point 34 intermediately positioned between ends of the arms 32 and 33 and with adjacent ends of the arms 32 and 33 coupled to the respective components 2 and 3 as illustrated. The pneumatic cylinder 25" is coupled to the opposite ends of the respective arms as shown, with the elastic member 35, e.g. a coil spring, wound about the pivot point 34 and coupled to the respective arms 32, 33.

In contrast to the previous two embodiments, expansion of the pneumatic actuator causes the ends of the arms 32, 33 respectively coupled to the components 2 and 3 to pivot towards one another and thereby move the components 2 and 3 towards one another and generate a positive pressure within the air-tight covering 6. When the pneumatic actuator 25" reaches its maximum expansion shown in FIG. 6, the force of the coil spring 35 takes over and biases the ends of the arms 32, 33 coupled to the components 2 and 3 away from one another to the position shown in FIG. 7, thereby generating the negative pressure within the air-tight covering 6.

In the embodiment shown in FIGS. 6 and 7, the mechanism still functions to create a negative pressure within the vest, causing the patient to inspire air into the lungs. However, in contrast to the previously-described embodiments, recoil of the coil spring 35 (and not the pneumatic actuator 25") explicitly generates the negative pressure within the vest 6, whereas active expansion of the pneumatic actuator 25" shown in FIG. 6 enhance the patient's exhalation.

Figure 8:
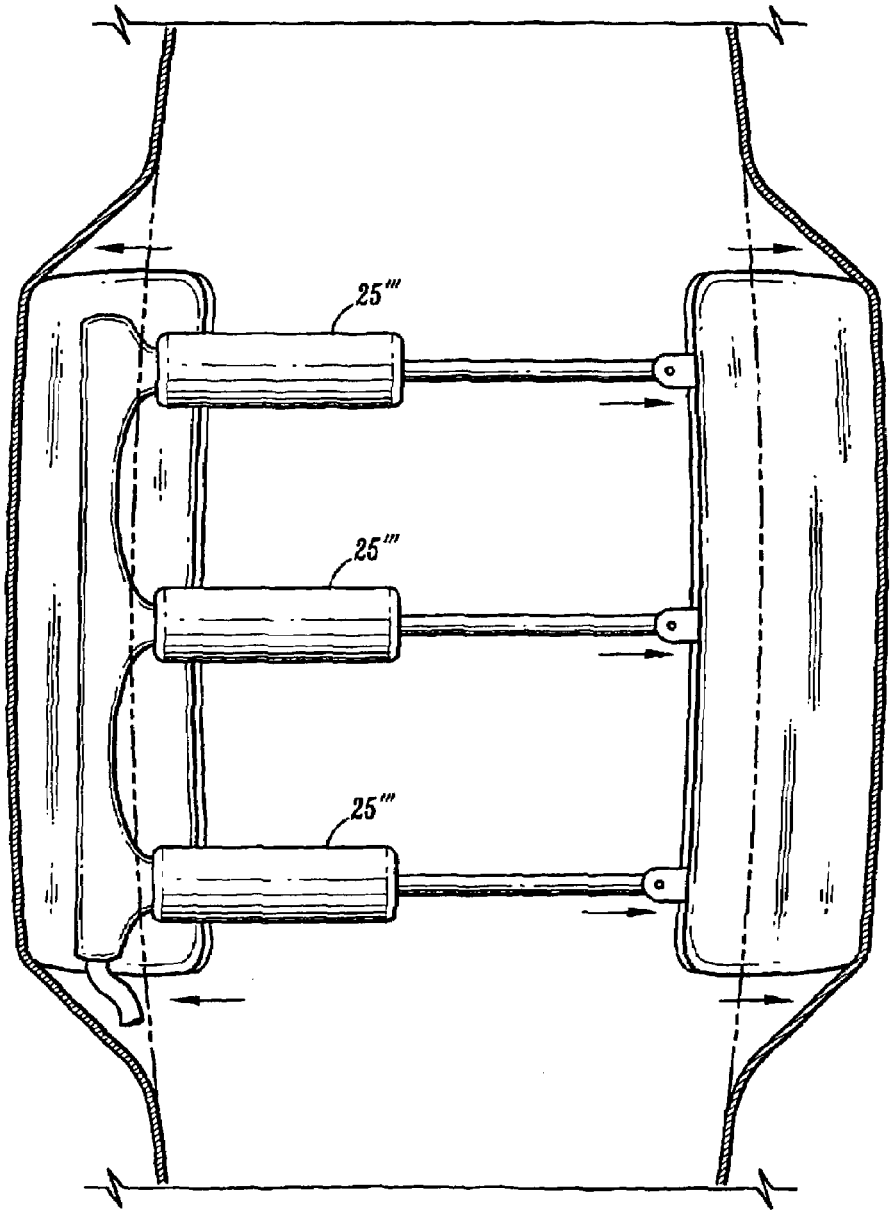
FIG. 8 is a plan view, similar to FIGS. 3, 5 and 7 and illustrating a further alternative embodiment of the present invention.
Figure 9:
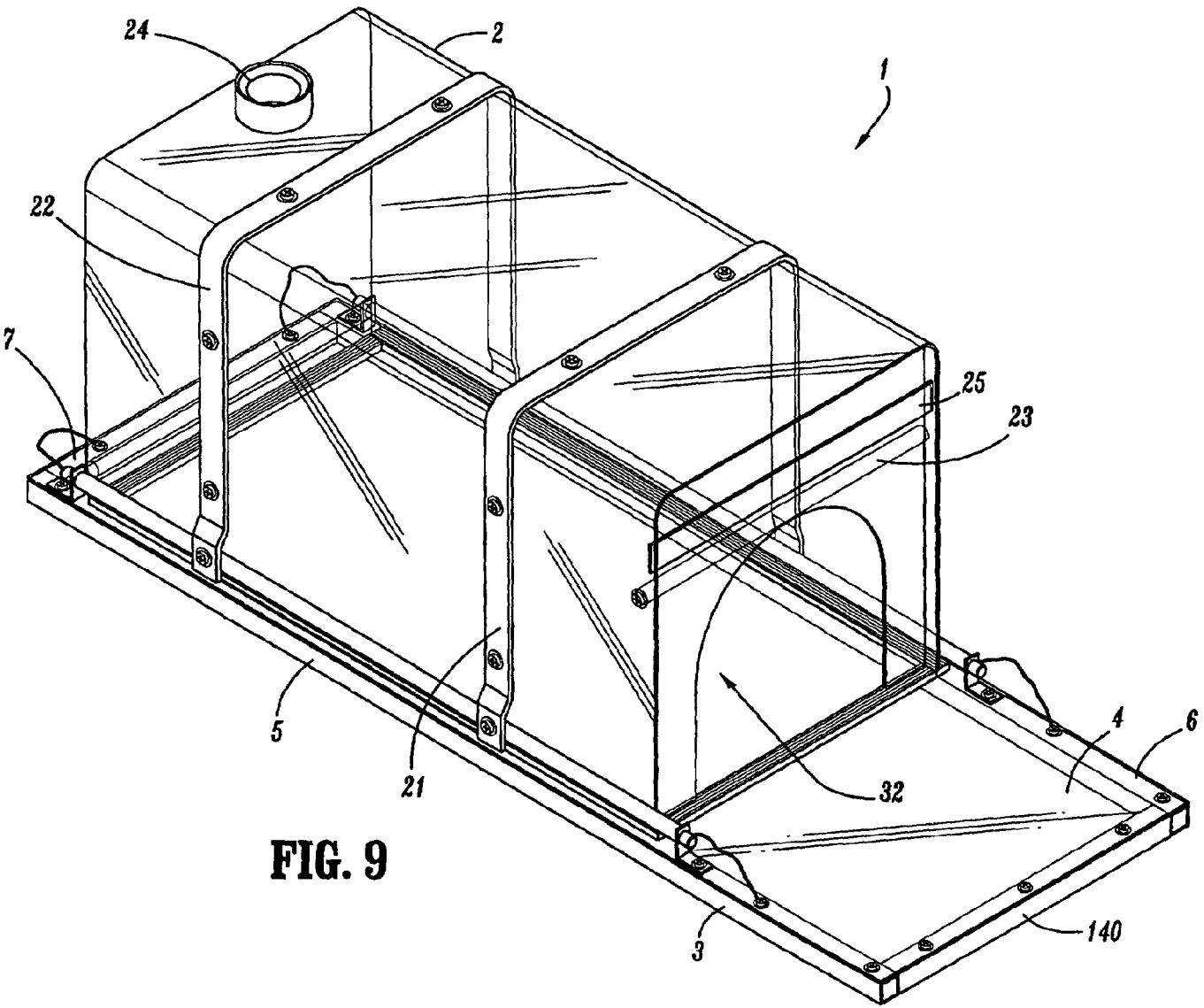
FIG. 9 illustrates a perspective view of the assembled negative pressure chamber ventilator of the present invention.
Figure 10:
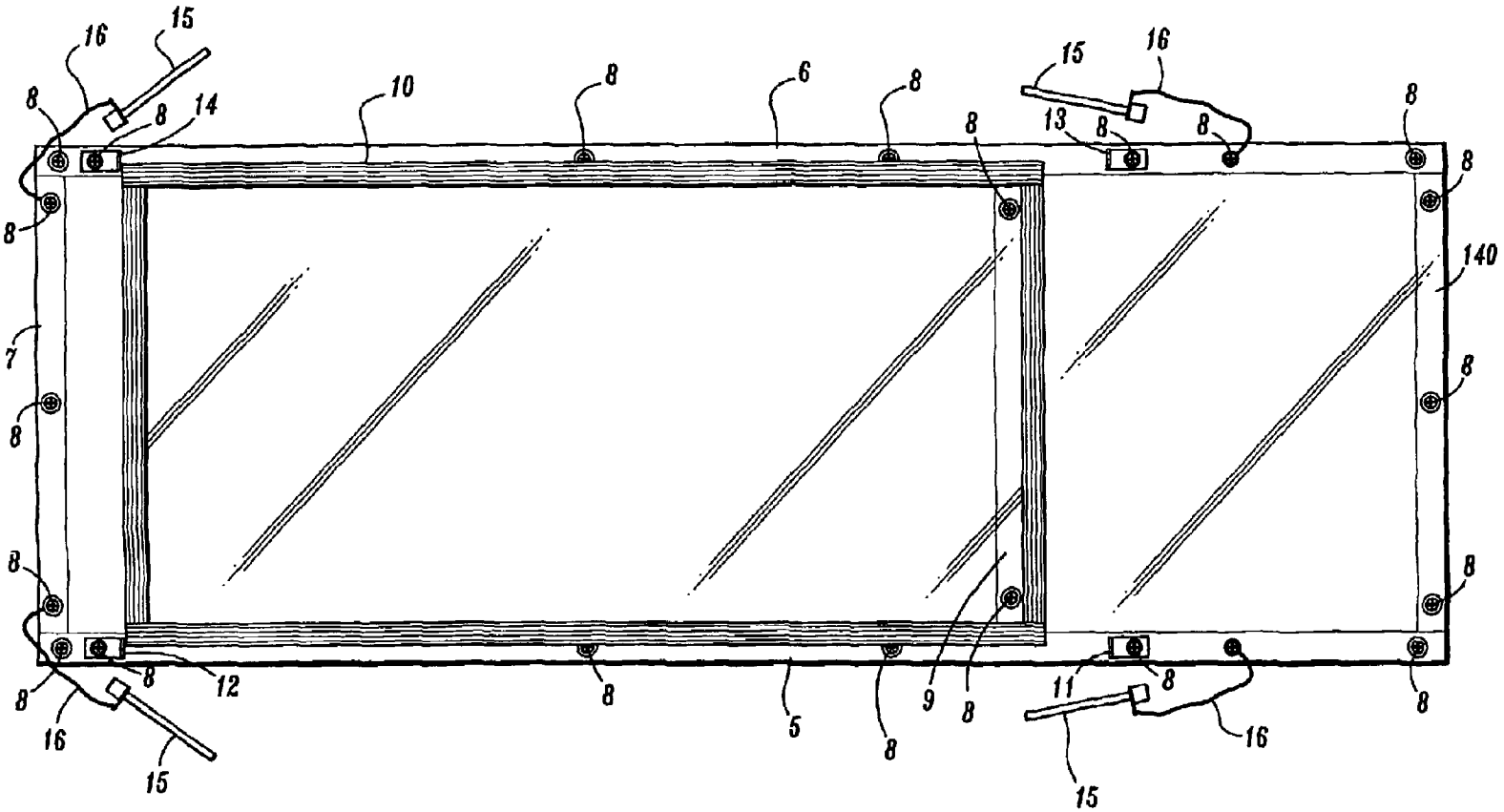
FIG. 10 is a top plan view of the platform forming part of the inventive ventilator.
Figure 11:
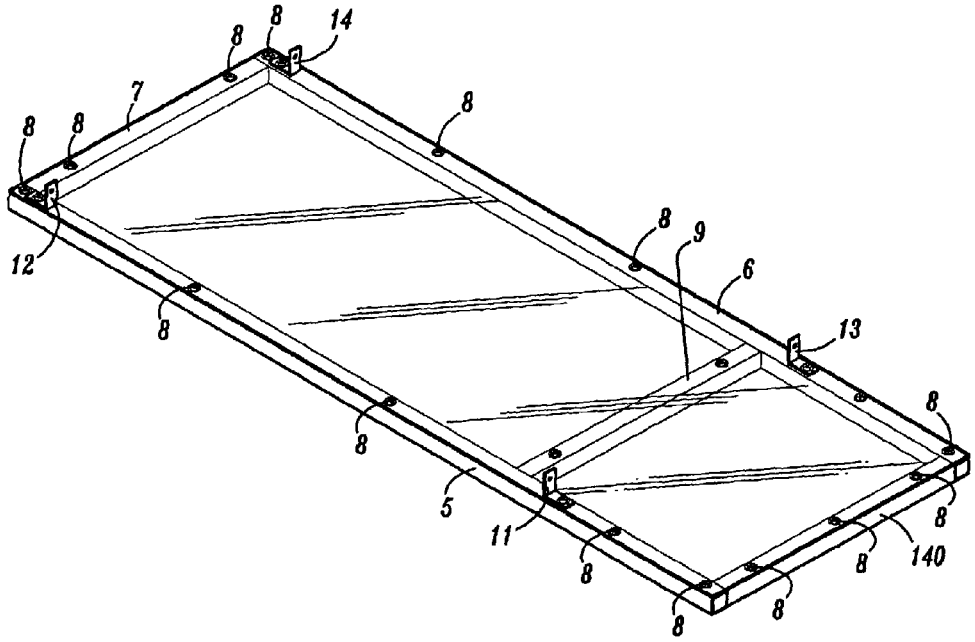
FIG. 11 is a perspective view of the platform shown in FIG. 9.

Referring to FIG. 8, the components 2 and 3 can be coupled directly to a series of spring-loaded actuators 25', 25", 25'" illustrated in extended or expanded position. Compressed gas within these actuator tubes activates all these actuators simultaneously. In other respects, the mechanism of ventilating a patient operates analogously to the other illustrated embodiments supra.

Any suitable, commercially-available pneumatic actuator can be used as the pneumatic actuator 25 in the inventive apparatus. One such pneumatic actuator is the commercially-available HONEYWELL MP909D1201 providing maximum air pressure 30 psi, nominal spring range 3 to 8 psi and a stroke of 2.4 inches.

Therefore, the present apparatus constitutes a self-contained, portable ventilation system permitting patients using the same to remain fully mobile. Improved patient mobility will also improve respiratory mechanics and quality of life. The inventive apparatus can be used either intermittently, or continuously throughout the day or night, and is always effective whether the patient is standing, sitting or lying down.

Referring to FIGS. 9-17, the inventive ventilator 1 is composed of a cover 2 secured to a platform 3 formed by a clear, plexiglass panel 4 being secured to aluminum beams 140, 5, 6, 7 by a series of phillips-head screws 8. Additionally, a support beam 9 is placed across the panel 4 and secured thereto by phillips-head screws. A corrugated rubber seal 10 is positioned about the upper edge of the platform 3 for sealing a base of the cover 2 when mounted thereon as described in greater detail infra. Four right-angle brackets 11, 12, 13, 14 are mounted upon the panel 4 through the respective phillips-head screw 8 and each comprise an orifice for receiving a respective pin 15 mounted upon an adjacent phillips-head screw through a chain 16. The beams 140, 5, 6, and 7 are formed from hollow aluminum tubing of substantially square cross-section The cover 2 of the inventive ventilator 1 is also formed from clear plexiglass material and comprises a substantially rectangular-parallelepiped shape with curved upper corners and an open bottom, as best seen in the perspective view of FIG. 12. However, the cover 2 may take any convenient shape in accordance with the present invention, e.g., semi-cylindrical, semi-elliptical, and variants thereof. Separate front 17 and rear 18 panels are affixed to the cover 2 by appropriate adhesive, e.g., an epoxy glue-silicone combination. The front panel 17 comprises a U-shaped portal 26. A hollow aluminum tube or pipe 19, 20 is mounted along bottom lateral edges of the cover 2, with an aluminum pipe 141 optionally mounted along a bottom edge of the rear panel 18.

Figure 12:
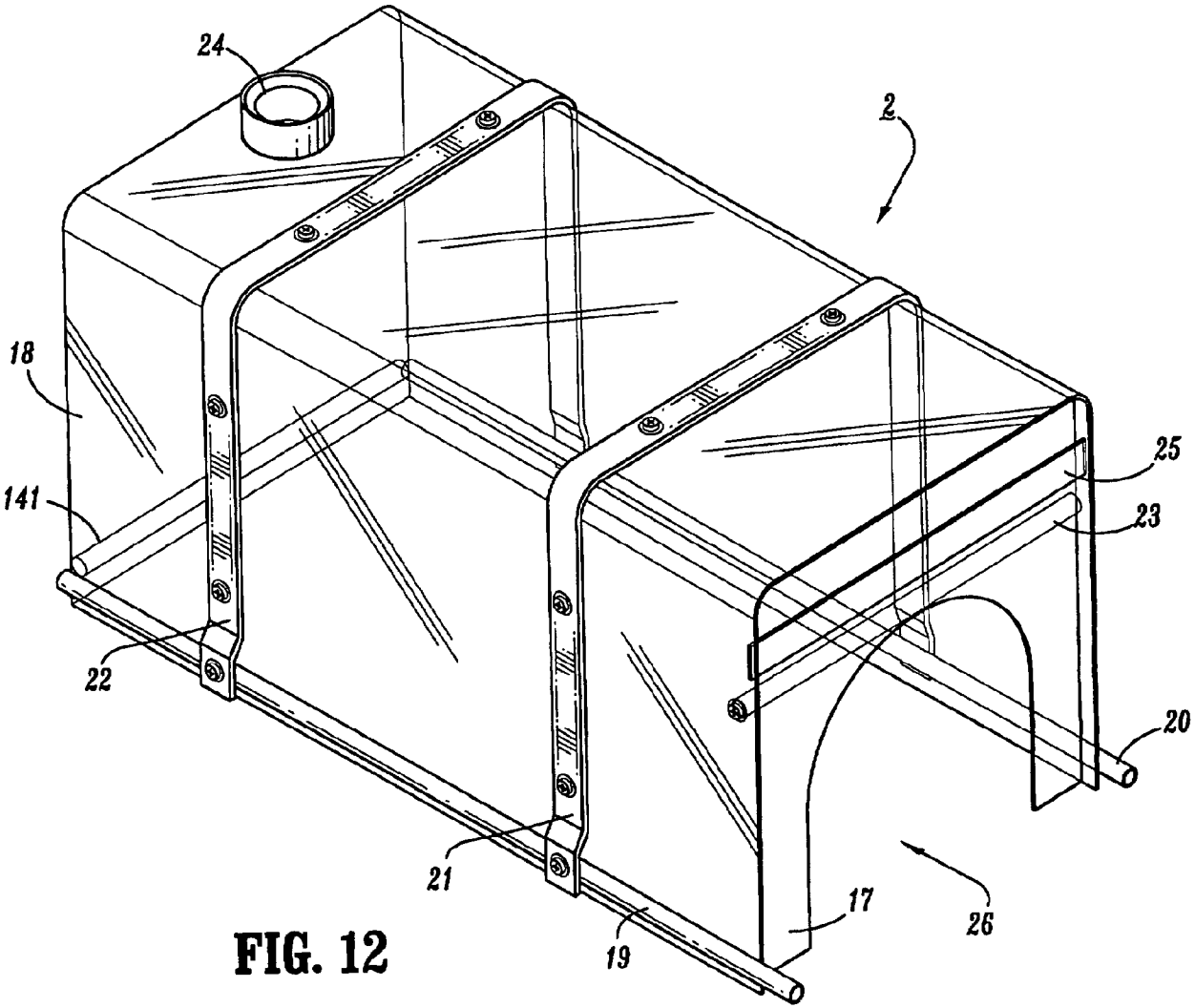
FIG. 12 is a perspective view of the cover forming part of the inventive ventilator.
Figure 13:
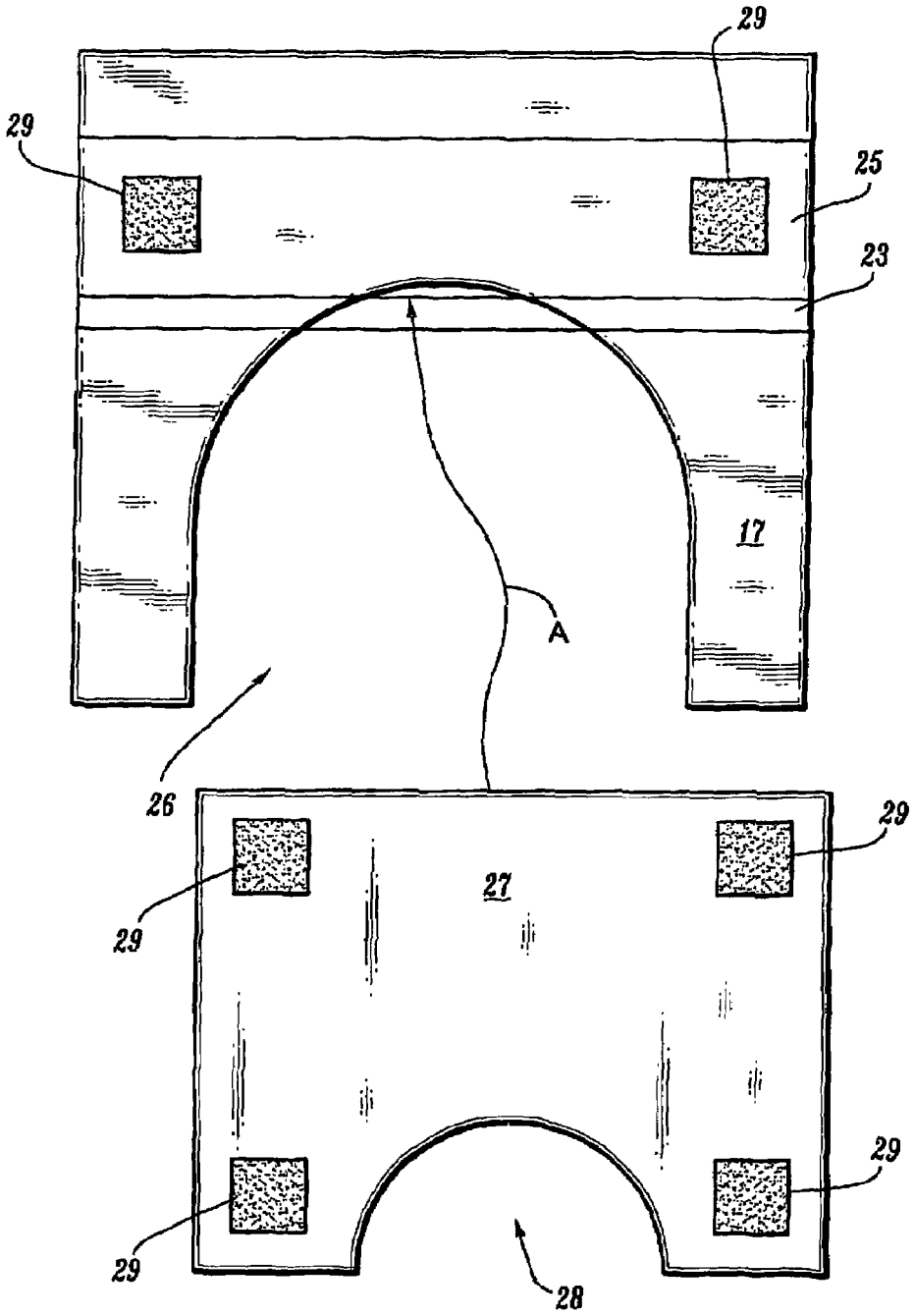
FIG. 13 is a schematic front view of the cover illustrating assembling of a front shield thereon.
Figure 14:
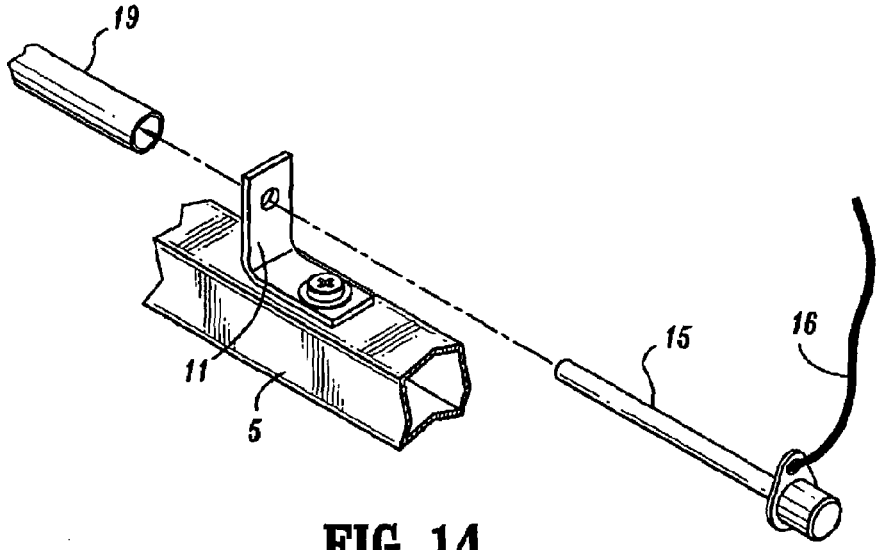
FIG. 14 is a schematic perspective view illustrating coupling of the cover to the platform.

Aluminum braces 21, 22 wrap around the top of the cover 2 and are affixed thereto by respective phillips-head screws and also to the respective aluminum pipes 19 and 20 to thereby secure the aluminum pipes 19 and 20 to the cover 2. An aluminum pipe serving as an additional brace 23 optionally extends across the front panel 17 as shown in FIG. 12. Additionally, a portal 24 is provided through the top of the cover 2 for coupling to inspiration mechanism. Furthermore, a separate front bracing panel 25 approximately rectangular in shape, is mounted across the front panel 17 of the cover 3 and slightly spaced therefrom, as described further infra.

To assemble the inventive ventilator 1, the cover 2 is simply placed on the platform 3 with bottom edges resting against the corrugated rubber seal 10. Next the respective pins 15 are inserted through the opening in an adjacent right-angle bracket 11, 12, 13, 14 and then into an open end of a respective aluminum tube or pipe 19 and 20 secured to the cover, to thereby fixedly mount the cover 2 upon the platform 3, as illustrated, e.g., in FIG. 14. Then, a separate shield 27 also comprising a U-shaped portal 28 but of smaller dimension than U-shaped portal 26 on the front panel 17 of the cover, is inserted between the front panel 17 and bracing panel 25 as illustrated, e.g., by arrow A in FIG. 13.

Figure 15:
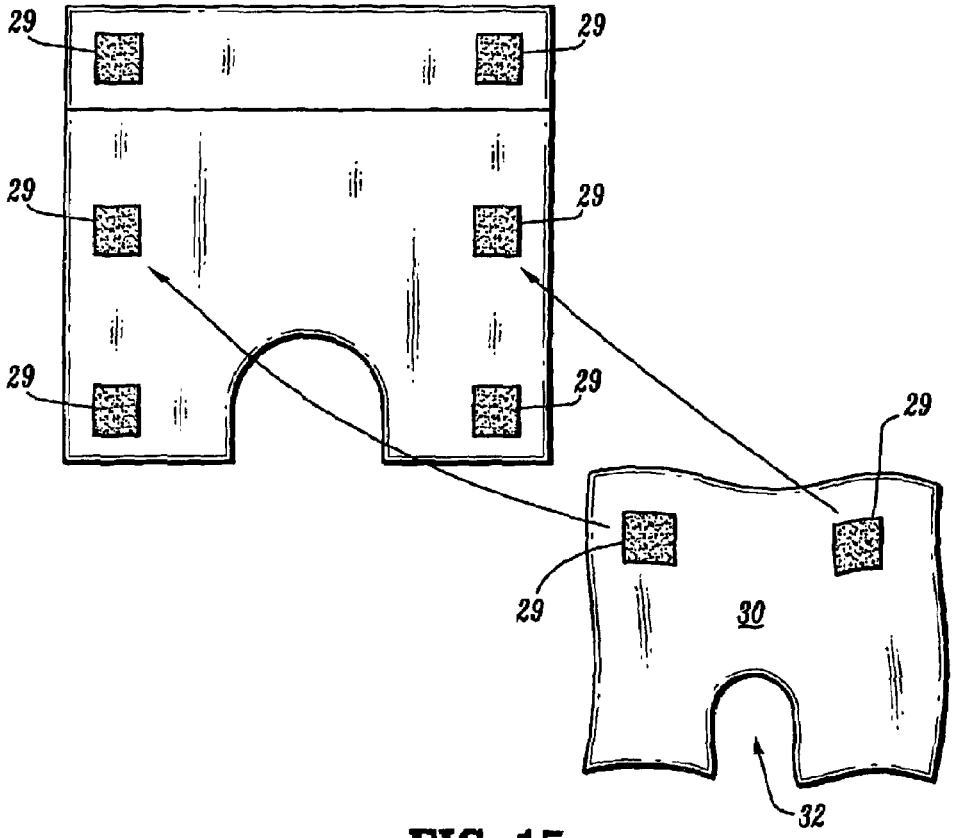
FIG. 15 is a schematic front view of the cover illustrating coupling of a flexible collar onto the front shield assembled according to FIG. 13.
Figure 17:
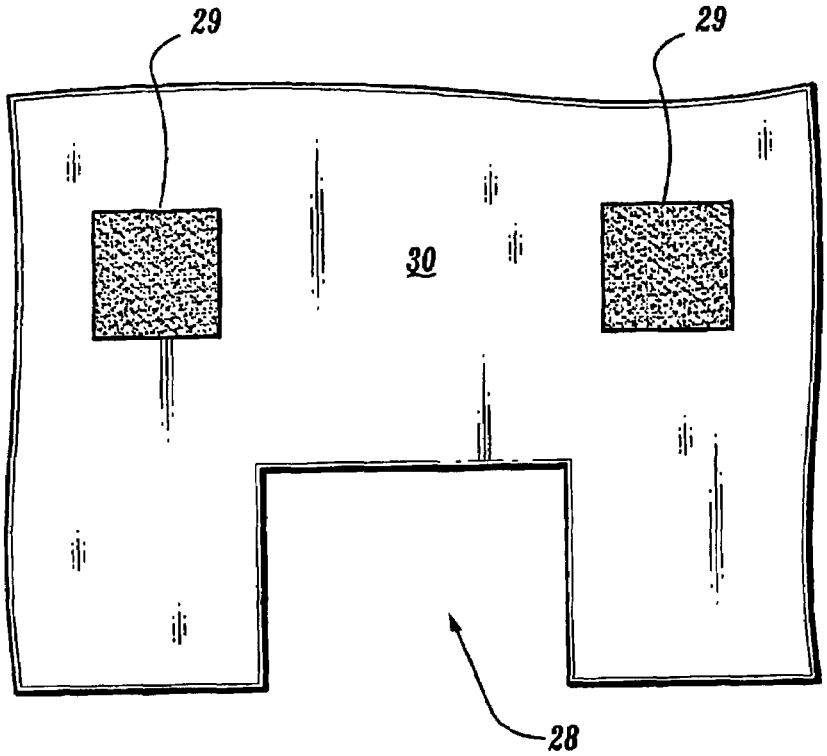
FIG. 17 illustrates an alternative shape of the flexible collar shown in FIG. 15.
Figure 19:
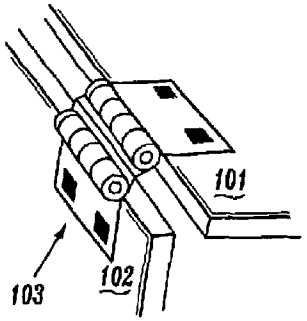
FIG. 19 is a view in the direction of arrow 19 of FIG. 18 and illustrating an enlarged view of the hinge arrangement coupling a door to the ventilator in closed position.
Figure 20:
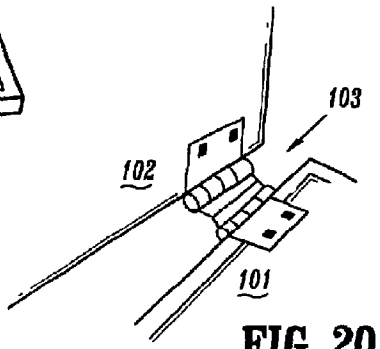
FIG. 20 is an inverted view of the hinge arrangement shown in FIG. 19 and illustrating the door in partially opened position.
Figure 18:
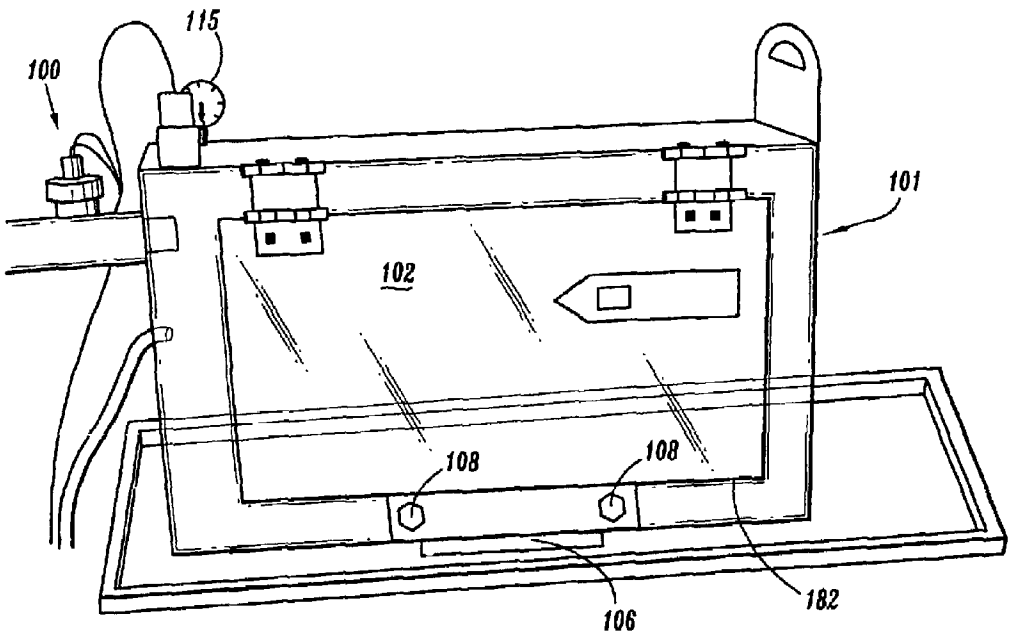
FIG. 18 illustrates a side elevational view of another embodiment of the negative pressure chamber ventilator in accordance with the present invention.
Figure 21:
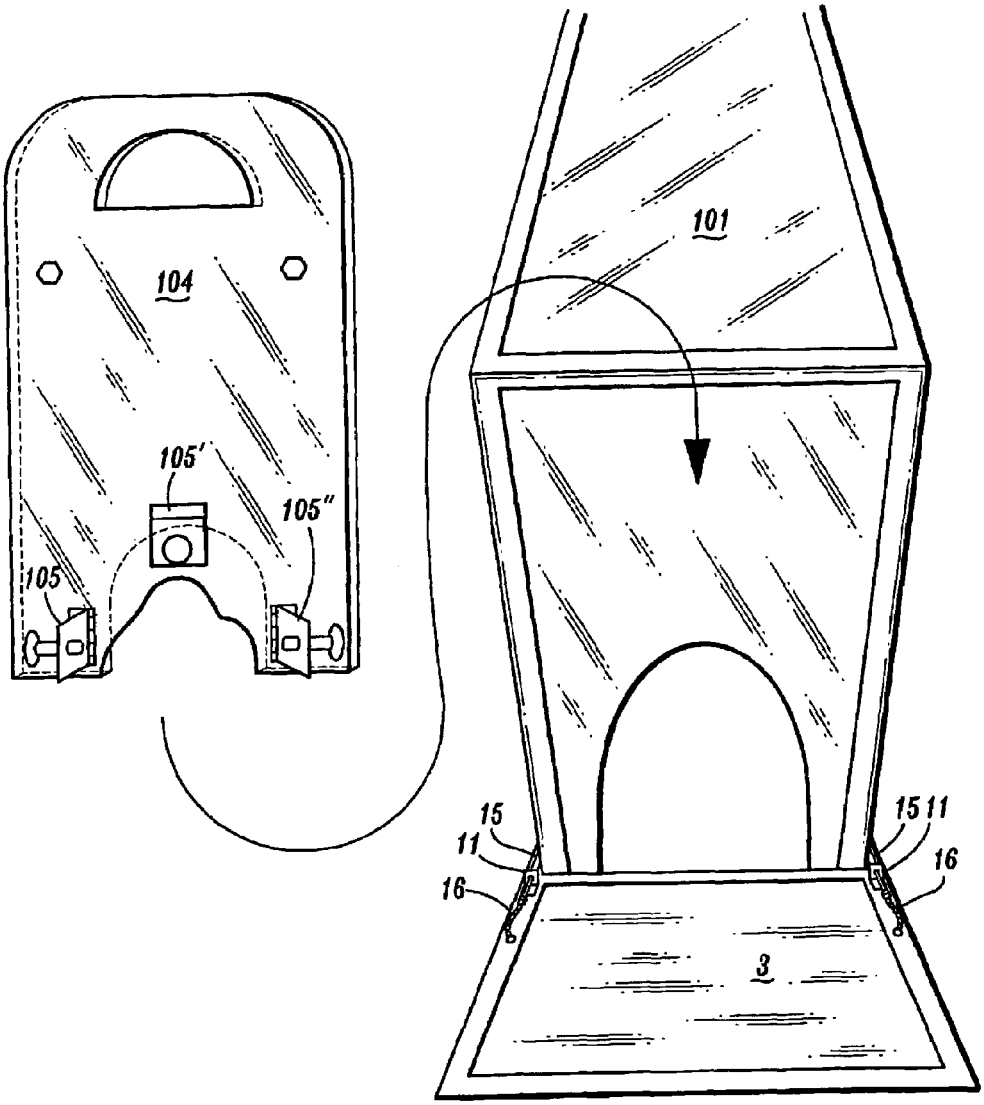
FIG. 21 illustrates a schematic view similar to FIG. 13 and illustrating coupling of a protective shield upon the front of the ventilator shown in FIG. 18.

Both the bracing panel 25 and front shield 27 are provided with several squares 29 of material for hook-and-loop, i.e., Velcro fastening with squares 29 of similar material placed upon a flexible collar 30 formed of soft plastic. as illustrated, e.g., in FIG. 15. The flexible collar 30 is also provided with a substantially U-shaped portal 32 of smaller dimension than U-shaped portal 28 of shield 27. However, the portal through the flexible collar 30 can take any convenient form, e.g., substantially rectangular as shown in FIG. 17.

Figure 16:
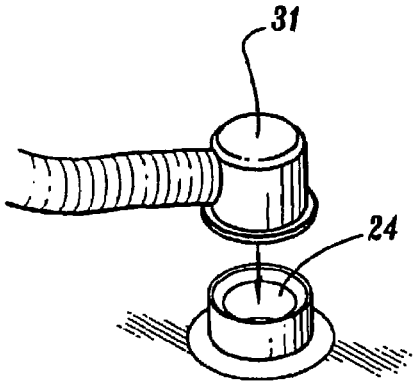
FIG. 16 is a schematic view illustrating coupling of a tube from driving mechanism to a portal through the cover of the inventive ventilator.

A tube 31 from the inspiration mechanism is coupled to portal 24 as shown, e.g., in FIG. 16. In practice, after the cover 2 is secured onto the platform 3, the patient, e.g., a premature infant, is slid into the ventilator with the infant's head resting upon the platform 3 outside the cover 2. Next, the shield 27 is gently and carefully slid between the front panel 17 and bracing panel 25 on the cover, with the appropriate size flexible collar 30 then conveniently fastened onto the shield 27 by the hook-and-loop fasteners 29. The brace 25 is then placed over the collar 30 and locked into position by lock-and-key mechanism directly into the side panels of the chamber to keep the collar 30 in position. The tube 31 from the inspiration mechanism can then be coupled to the portal 24 of the cover 2, if not done previously. The inventive respirator 1 is now ready for operation.

Any suitable negative pressure ventilation mechanism can be used with the inventive ventilator 1. One preferred mechanism is marketed as the NEV®-100 Non-Invasive Ventilator by Respironics, Inc. (www.Respironics.com) and is disclosed in U.S. Pat. No. 5,299,599 issued Apr. 5, 2004, the contents of which are incorporated by reference herein. The coupling tube 31 is of flexible, corrugated, accordion-shaped construction. Specifically, negative pressure is created within the interior 32 of the ventilator 1 by the inspiration mechanism which causes the patient to inhale; reduction of negative pressure during the breathing cycle then allows the patient to exhale by natural elastic recoil of the lungs.

Referring to FIGS. 18-31 in particular, the inventive ventilator 100 and chamber 101 eliminates the disadvantages encountered in the prior art devices described in the background portion of the present application. The chamber 101 itself is manufactured from one-half inch thick Lexan plexiglass, sufficiently sturdy to withstand the vacuum pressures required in clinical operation. The walls of the chamber 101 are thus transparent on all six sides, allowing medical staff to easily observe the patient from any angle at all times, thus improving patient care and safety. The access door 102 used for inserting and removing a patient into and out of the chamber 101 utilizes a double-hinge system 103, allowing a caretaker to easily open the door 102 and place the door panel flatly on top of the chamber 101 during non-use. Additionally, the patient, i.e., infant is still fully visible, even when the access door 102 is resting on top of the chamber 101.

Furthermore, the access door 102 possesses separate locking mechanisms 108 from the door handle 106. These separate locking mechanisms 108 cannot be accidentally misplaced or misaligned. The locking mechanisms 108 are situated away from the door handle 106. Additionally, the front door or shield 104 possesses three latch-and-hinge locking mechanisms 105, 105', 105" for coupling to the neck collar 107 of the patient, i.e., infant. The portion of the chamber 101 surrounding the patient's neck is specifically designed such that the patient's head is easily accessible and can move freely and, at the same time, be quickly removed from the chamber 101, if necessary. In an explicit improvement over conventional ventilator designs, the patient's extrathoracic airway (cervical trachea) is included within the vacuum mechanism of the chamber 101.

Figure 22:
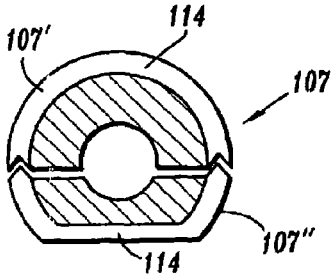
FIG. 22 illustrates a protective collar arranged to be coupled about the neck of a patient situated within the ventilator shown in FIG. 21 and sealing the vacuum created within the ventilator.
Figure 23:
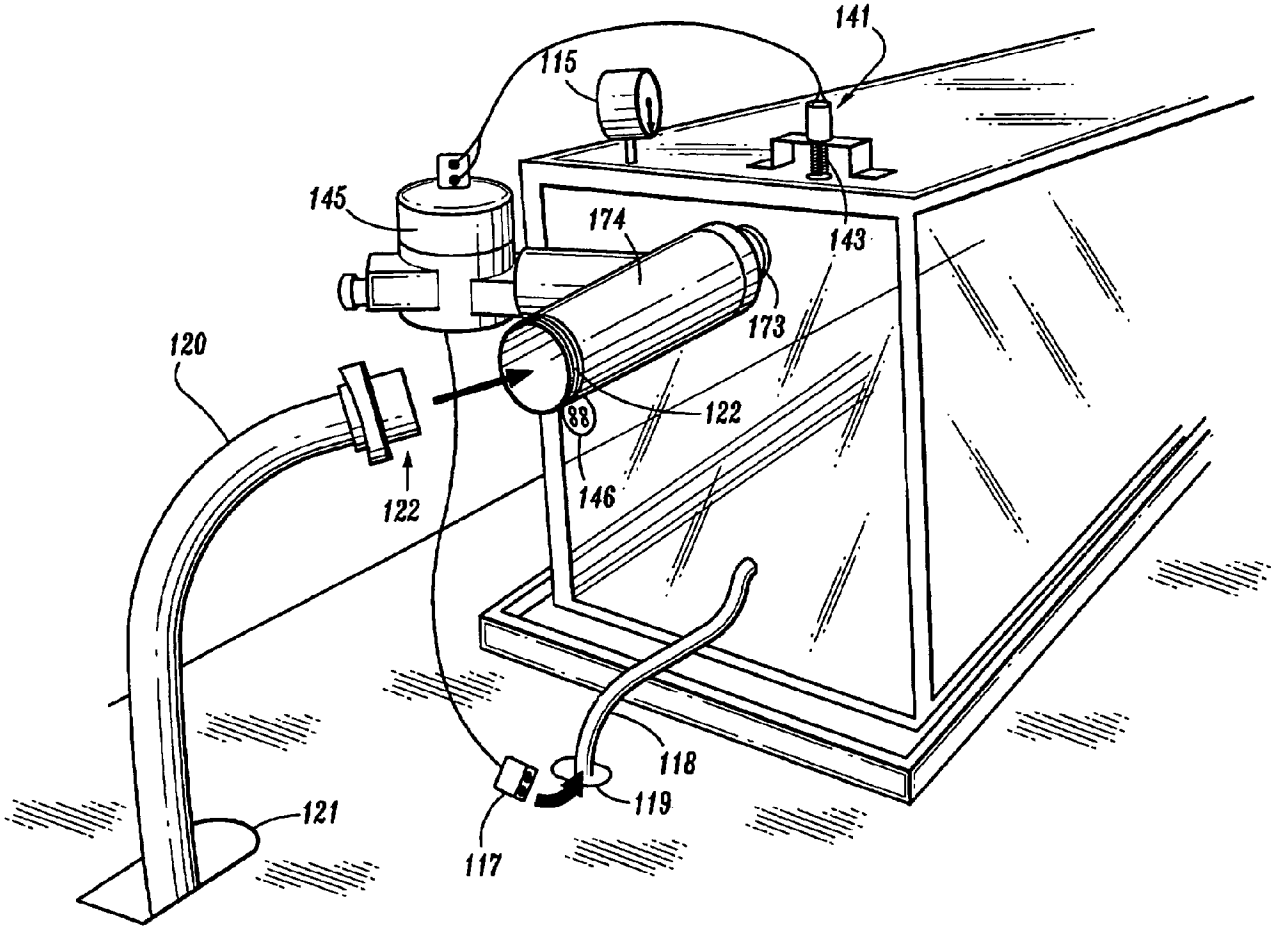
FIG. 23 is a schematic, rear perspective view of the ventilator shown in FIG. 21 and illustrating positioning and coupling of ventilation mechanism to the chamber.
Figure 24:
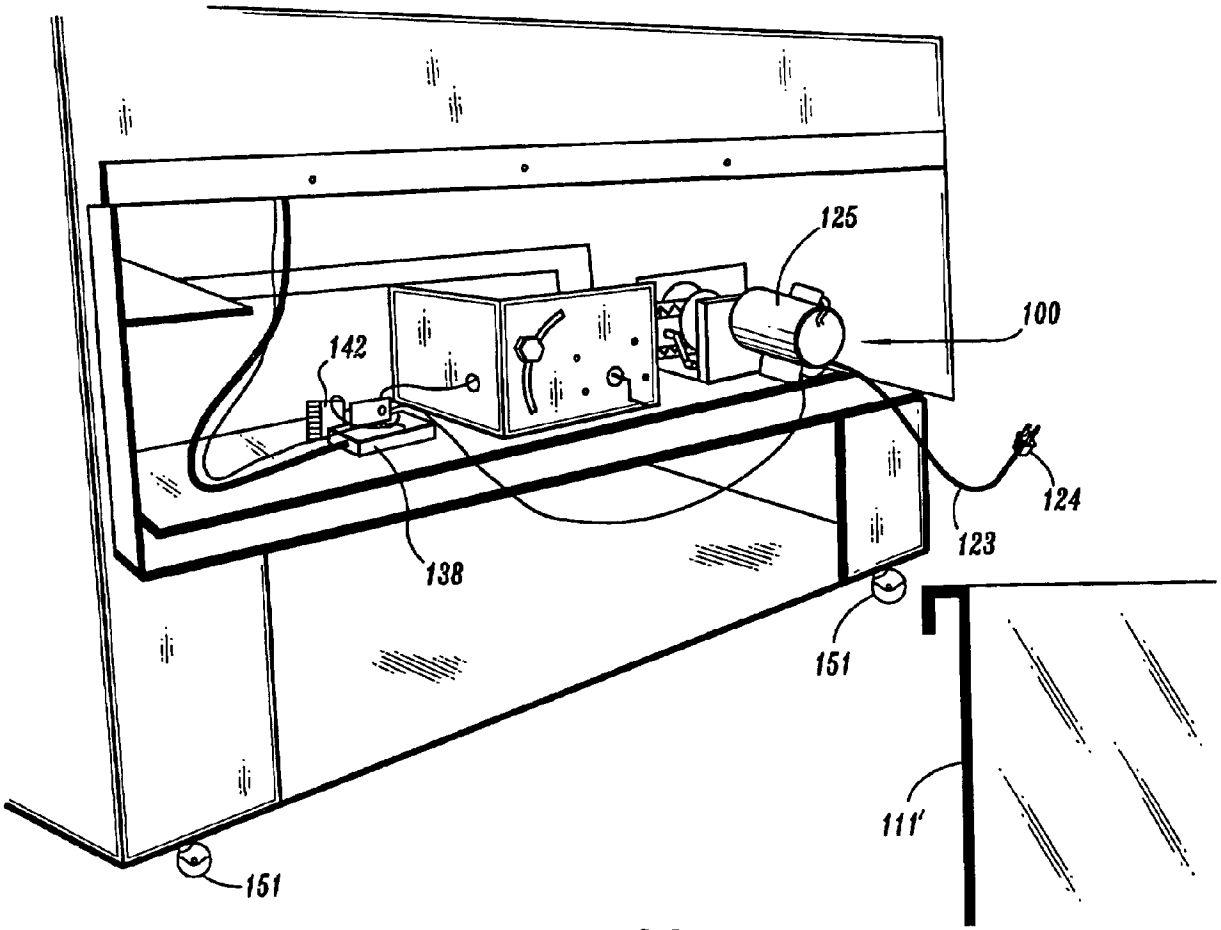
FIG. 24 illustrates storage of the ventilation mechanism prior to coupling to the ventilator as shown in FIG. 23.
Figure 25:
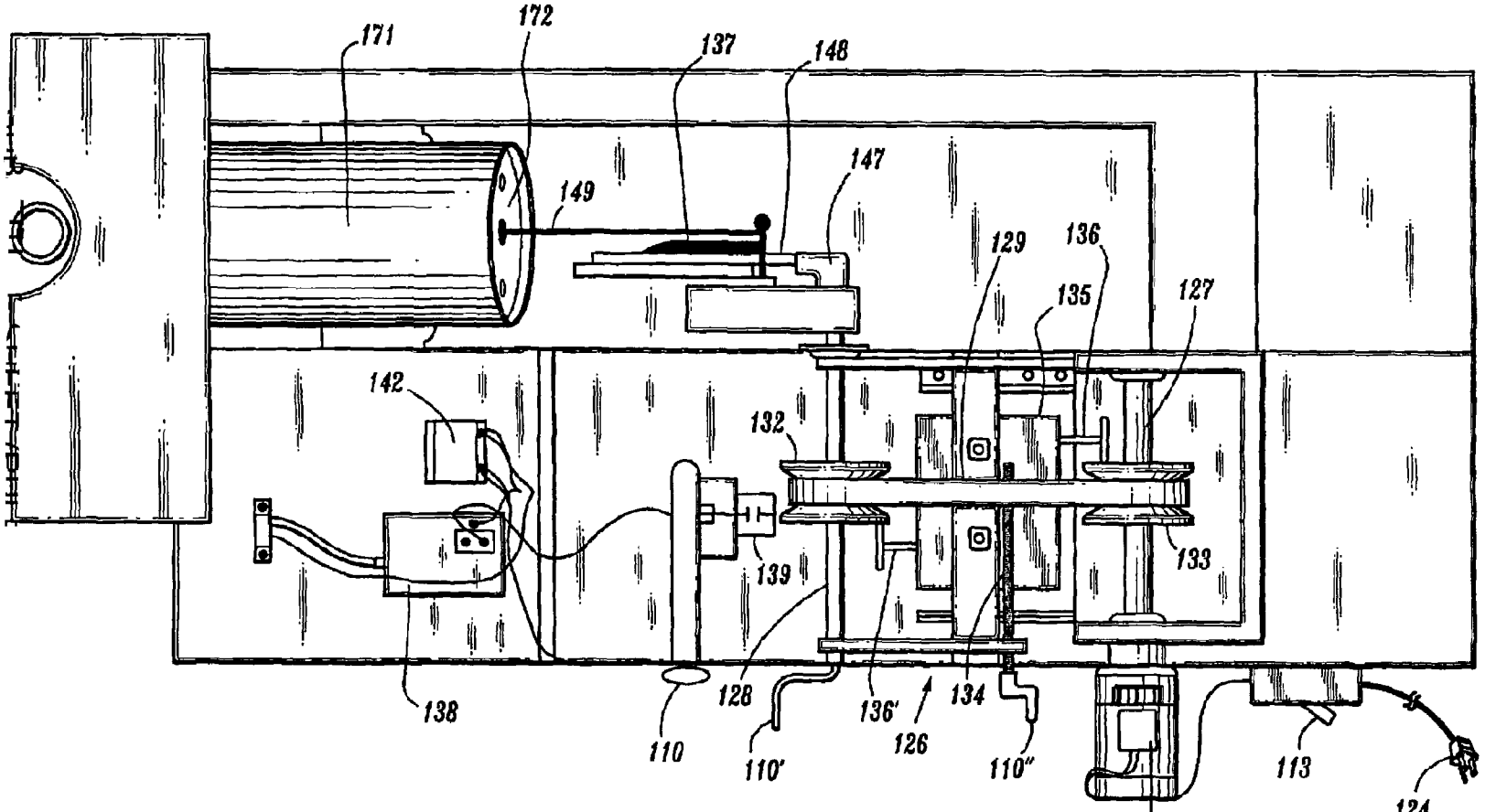
FIG. 25 illustrates a top plan view of the ventilation mechanism shown in FIG. 23 and illustrating ease of servicing the ventilation mechanism.

The portion of the chamber 101 forming the seal around the infant's chin, i.e., the protective collar 107 shown in FIG. 22, is constituted by two mating parts 107' and 107", each composed of a soft bib-like material and easily-disinfected, thinly coated polyurethane gel. The ventilator 100 and chamber 101 are designed to operate as an integral unit with ventilator controls 110, 110',110" (FIG. 25) easily accessible from the front of a housing cabinet 111 supporting the unit as shown, e.g., in FIG. 28. This cabinet 111 can be easily opened for simple exchange of ventilator units, if maintenance is required, as shown in FIG. 24 where covering panel 111' has been unhooked.

The ventilator chamber 101 itself is explicitly designed to include the extrathoracic airway (cervical trachea) of the patient within the vacuum portion of the chamber 101. This allows for dilation of the extrathoracic airway during creation of the negative pressure. Poiseuille's Law describes the pressure gradient required to maintain laminar flow through a tube:

$$\Delta P = \frac{\eta V L}{r^4}$$

where the tube represents the extrathoracic airway of the patient,

- ΔP denotes the pressure differential required to maintain laminar gas flow,
- η denotes the viscosity of the fluid (air/oxygen) flowing through the tube,
- V denotes the flow of the fluid or gas,
- L denotes the length of the tube, and
- r denotes the internal radius of the tube.

This radius of the airway is of critical importance in determining the airway resistance (ΔP/V), with even a tiny decrease in the radius of the upper airway requiring a tremendous increase in driving pressure of the gas to maintain the same laminar flow rate. Once the flow rate becomes high, then the airflow becomes turbulent and results in total disorganization of flow, leading to inefficiency in delivery of the gas. The compressible nature of the neonatal and infant airway has led to failure of previously-available negative pressure ventilators to efficiently function in this patient population.

A medical grade thermometer 112 is placed inside the chamber 101 to ensure safety of the temperature environment for the infant. Heat and fluid are quite easily dissipated from skin of a newborn infant, with high inflow rates of non-heated, non-humidified air also placing some infants at risk. In this regard, the present invention is also directed to a method of heating and/or humidifying the gas utilized to create the vacuum pressure within the chamber 101. A heating/humidifying unit can be easily coupled to the ventilation mechanism within the context of the present invention.

Figure 26:
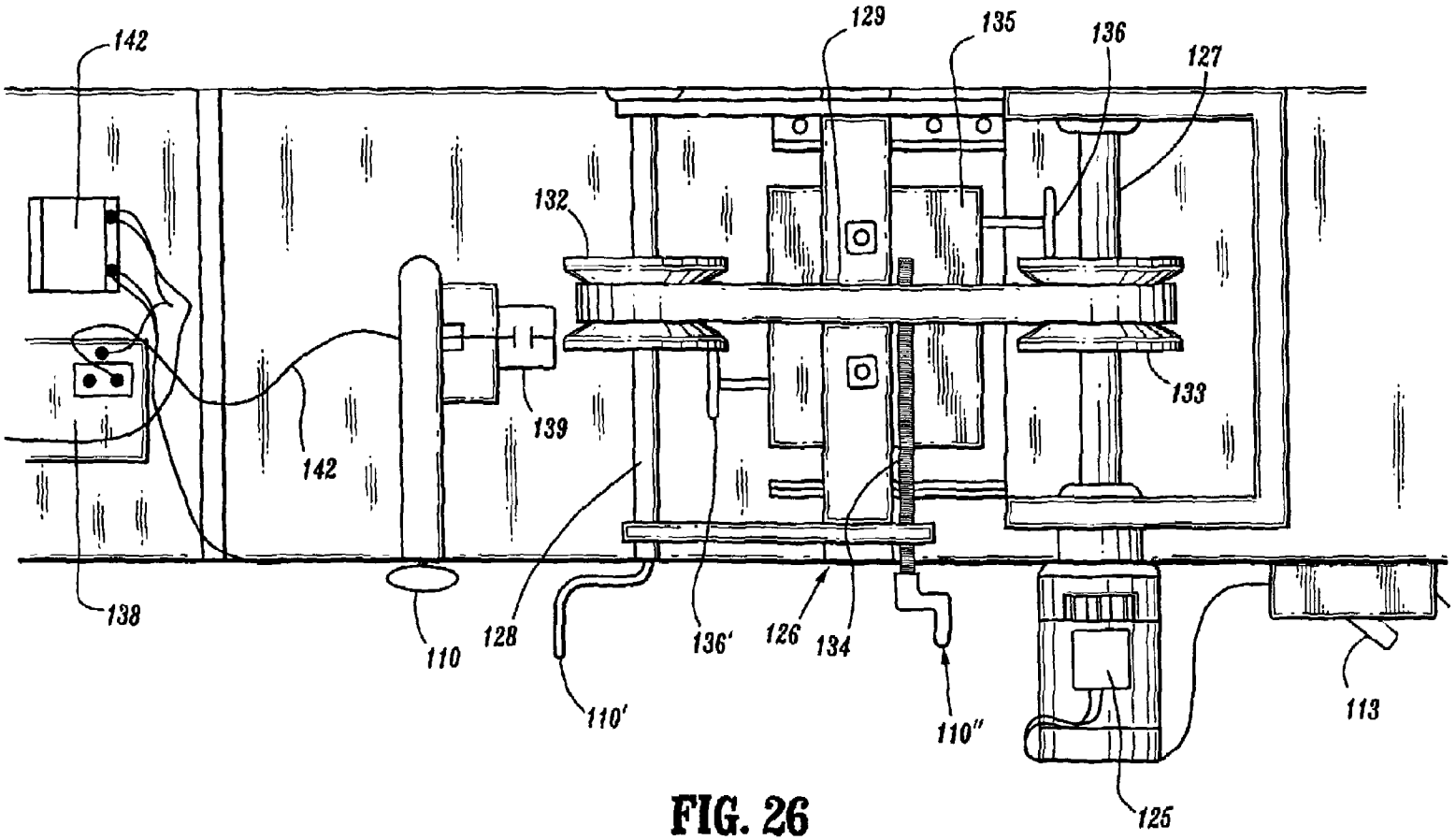
FIG. 26 illustrates an enlarged view of part of the ventilation mechanism shown in FIG. 25.
Figure 27:
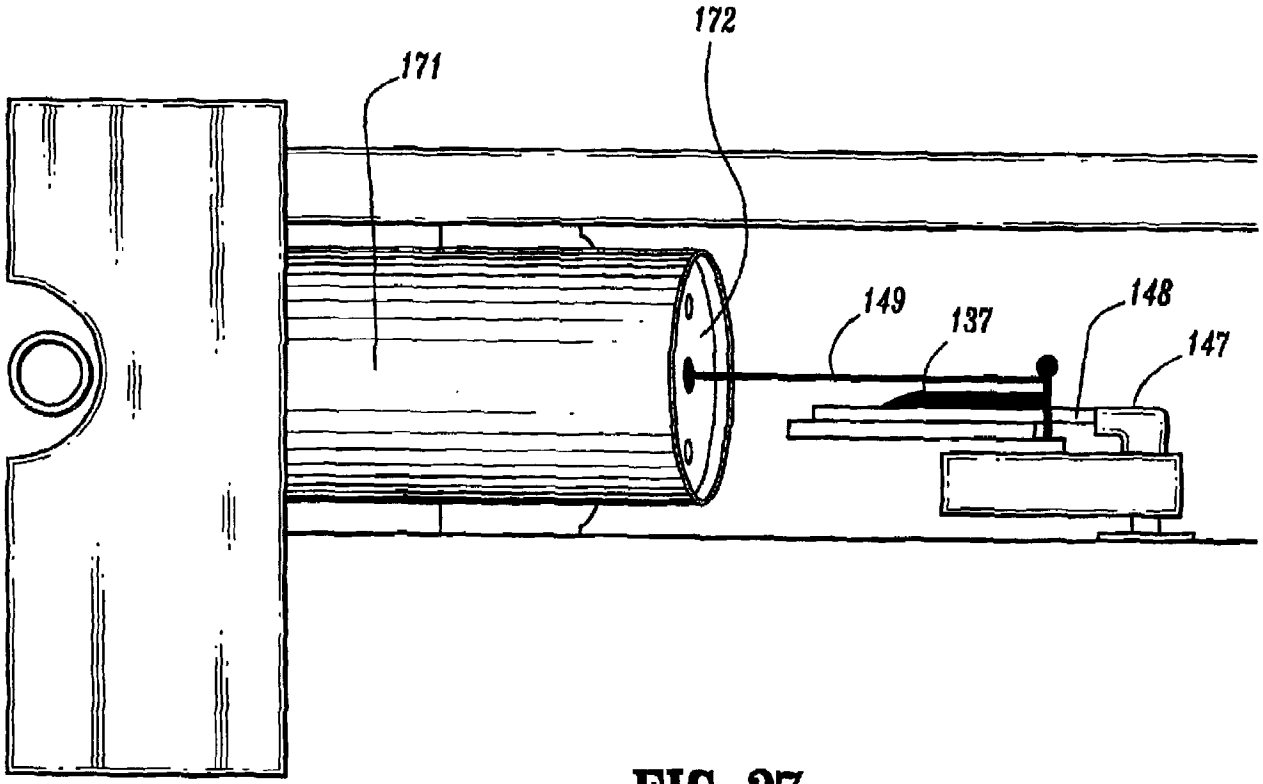
FIG. 27 illustrates an enlarged view of another part of the ventilation mechanism shown in FIG. 25.
Figure 28:
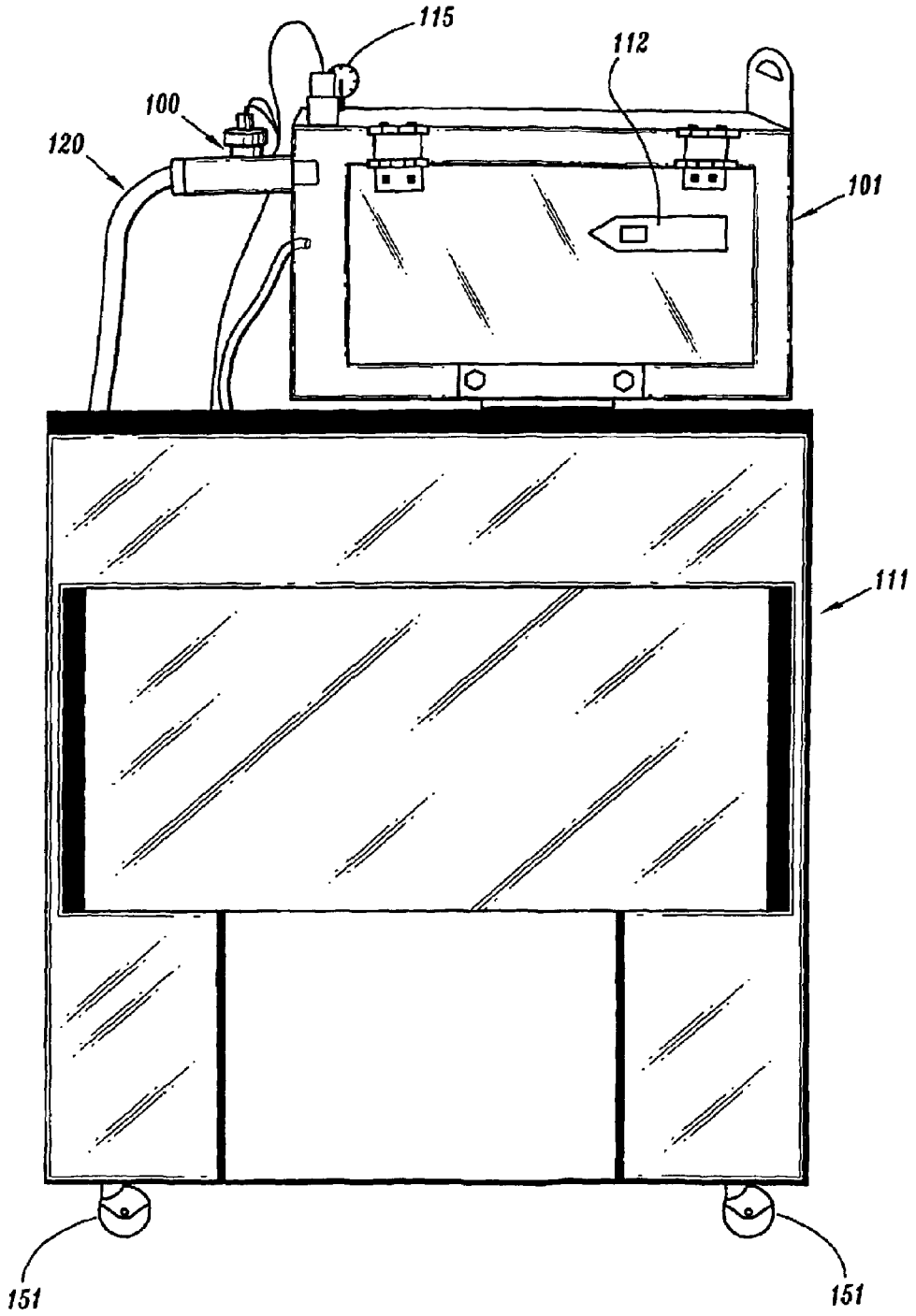
FIG. 28 illustrates a side elevational view of the ventilator as positioned upon a support cabinet housing the ventilation mechanism with front cover in position to obscure mechanism shown in FIG. 24.

The inventive negative pressure ventilator as shown, e.g., in FIGS. 18-31, is explicitly designed to provide rapid attaining of desired settings, both at onset of therapy and with re-establishing appropriate seals after removing the infant patient for other caring. When such patient is removed, the ventilator 100 can be left on and will automatically achieve the desired settings within approximately five seconds after establishing the appropriate seals (i.e., closing the access door 102), without any action from the operator. If a patient is removed for an extended period, then the ventilator 100 can be shut off by simply turning a single switch 113 (FIG. 26). When the patient is again placed inside the chamber 101, then the desired settings will be easily attained upon establishing the proper seals. The ventilator 100 can be safely turned on either before or after establishing these seals.

As pointed out above, the upper airway and neck of a patient will be included within the chamber 101 of the negative pressure system. The head and face of a patient will be exposed for feeding, care and interaction. A special shield mechanism 104 near the patient's head allows for easy access to the patient, especially an infant. This mechanism 104 can also provide an alternative route for placing or removing the infant patient either into or out from the ventilator chamber 101. In particular, this special shielding mechanism 104 possesses a three-point locking system 105, 105', 105'" to ensure maintenance of the seal yet permit easy opening. There is a double-layered plexiglass sheet 104 which can be pulled upwardly, thus freeing the two collar components 107' and 107" which surround the infant's chin. This safety mechanism allows the infant head to be completely freed from the ventilator should an emergency occur. Outer rings 114 of collar components 107', 107" are made of rigid plexiglass.

There is a four-pin system 11, 15, 16 holding the entire top of the chamber 101 to the base portion 3. In the case of an extreme emergency, such as when the infant might need to be accessed for cardiopulmonary resuscitation or urgent procedures, the four pins 15 can simply be pulled out and the entire top of the chamber 101 will be freed from the base 3 within several seconds. The infant's neck will automatically be freed from the holding collar mechanism 107, with any intravenous or monitoring systems 150 attached to the infant remaining with the base 3. To replace the upper portion of the chamber 101, the lightweight top is simply aligned with the base 3 and the four pins 15 reinserted as before.

The support cabinet 111 for the ventilation unit is provided with four support wheels 151 that can be locked, for easy moving of the entire ventilation system 100, 101, 111. This mode of ventilation can be used with patients who are not intubated, those who are intubated through the mouth or nose, or those who have a tracheostomy in place. The ventilator breath rate, inspiratory time and negative pressure settings can all be adjusted, either while the machine 100 is functioning, or while it is turned off. Adjustments can be made even while a patient is within the chamber 101.

A pressure gauge 115 is mounted on top of the chamber 101 to continuously monitor the negative pressures generated within the chamber 101. All of the mechanical parts are completely separated from the ventilation chamber 101 and situated, e.g., on the first shelf of the support cabinet as illustrated in FIG. 24. More particularly, the electrical connections 117 and vacuum sensors 118 are easily coupled to the chamber through a hole 119 in the top of the cabinet 111. The vacuum hose 120 is connected through a separate hole 121 in the top of the cabinet 111 and secured in place by a threading mechanism 122. All three connections 117, 118 and 121 can be easily disconnected in the event the chamber 101 or electrical mechanism must be exchanged.

The ventilator 100 is wired to operate by a single electrical power cord 123 and switch 113. The final product includes a three-prong plug 124 with a ground wire for patient safety. The operator turns the unit on by the flip of a simple two-way switch 113, which, when turned to the "on" position, allows the contacts to close, thus completing the electrical circuit. The electrical energy is then converted into mechanical energy by an electrical motor 125 designed to rotate, e.g., 35 times per minute. A capacitance motor unaffected by any power fluctuations is preferably used.

Mechanical operation of the inventive ventilator 100 is based upon a torque-conversion system constructed in a wheel-and-belt configuration 126. The engine turns one axle of the torque converter (the motor-side drive shaft 127) at a steady rate and power output. A second axle (the adjustable secondary drive shaft 128) is synchronized with the first axle 127 by a thick, rubberized symmetrical V-drive belt 129 located in the middle of each drive shaft 127, 128, surrounded by graduated side walls 130, 131. The width of each wheel 132, 133 is controlled by a single torque converter 126 that is attached to a handle 110" outside the machinery box. The operator can turn the handle 110" to adjust a threaded bolt 134 that is welded to a sliding metal plate 135 in turn attached to a ball-bearing roller 136, 136' on both the motor-side drive shaft 127 and secondary drive shaft 128 ends. The rollers 136, 136' operate in concert to simultaneously move only the distal graduated side of the motor-end wheel 133 and only the proximal graduated side of the secondary wheel 132 in the same lateral direction.

Figure 30:
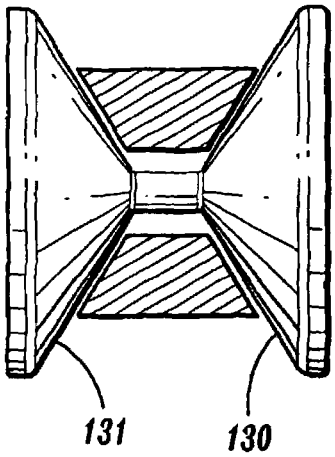
FIG. 30 illustrates a cross-sectional view of a drive belt for the ventilation mechanism.
Figure 31:
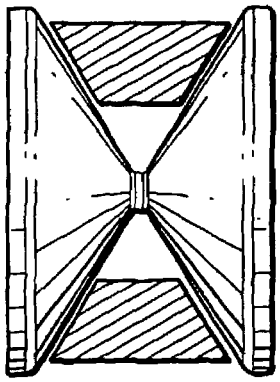
FIG. 31 illustrates the drive belt of FIG. 30 in compressed condition.

This action serves to concurrently widen one wheel 132 or 133 and equidistantly narrow the other 133 or 132. When the handle 110' is turned clockwise, the graduated sides of the motor end wheel 133 are brought together, essentially forcing the rubber belt 129 to ride higher on this wheel 133 (FIG. 31). This mechanism is equivalent to increasing the diameter of the motor side wheel 133. At the same time, the graduated sides of the secondary wheel 132 are brought exactly the same distance apart as the motor wheel's sides are brought together. As these graduated sides move apart, the rubber belt 129 is allowed to slip deeper into the groove created between the sides of the secondary wheel 132. This mechanism is equivalent to decreasing the diameter of the secondary wheel 132 (FIG. 30).

By creating a torque-conversion system 126 constructed in a wheel-and-belt configuration, the ventilator 100 can be smoothly adjusted to any desired setting during operation without disruption. Tension of the belt 129 will always remain constant, as the system is structured to move one edge of each of the wheels 132, 133 equidistantly and in simultaneously opposite directions.

The adjustable secondary drive shaft 128 is connected to the piston operating arm 137 and controls the speed and force of rotation of the arm 137. The relative size of the two wheels 132, 133 controls both speed and force of such rotation of the piston arm 137. The larger the relative diameter of the secondary wheel 132, the slower the speed but greater the force, and vice versa. The graduations on each wheel 132, 133 can be made to any desired specification, thus providing any number of respirations per minute. For example, the ventilator 100 is easily adjustable to provide 10-40 respirations per minute.

Thus, the rate of respirations can be adjusted by adjusting the torque-converter 126. Turning the converter 126 clockwise increases the rate and counterclockwise decreases the rate. Negative pressure created within the chamber 101 remains the same if the pressure sensor solenoid switch 138 is unchanged, a desirable feature as an operator generally wants to change only one respiratory parameter at a time. The level of the negative pressure generated inside the chamber 101 can be altered by adjusting both the torque converter 126 and the pressure solenoid sensor switch 138.

Duration of inspiration time can be adjusted as a percentage of entire breath. The proximal side of the secondary drive wheel 132 has a metal plate extending from a portion of an edge, rotating with the secondary drive shaft 128 and specifically located to contact a metal trigger plate 139 electrically wired via a transformer 142 to the pressure-sensor solenoid switch 138 and a pressure-release valve mechanism 141. When activated, this release valve 141 eliminates all of the negative pressure inside the chamber 101 itself. The length of the protruding metal plate only contacts the trigger plate 139 during the "upswing" of the piston operating arm 137 or creation of the vacuum and does not contact the trigger plate 139 when the vacuum is no longer being created.

When the protruding metal portion of the secondary drive wheel 132 comes into contact with the metal trigger plate 139 of the pressure release valve mechanism 141 behind it, the trigger plate 139 is forced to contact the wire 142 and thus complete an electrical circuit. Inspiration time can be adjusted by altering the relationship between the metal plate on the secondary drive wheel 132 and trigger plate 139 on the pressure release valve mechanism 141. An adjustment knob 110 is built into the cabinet 111 for this modification. The system is fully adjustable to trigger the valve 141 opening at any fraction of a complete respiratory cycle, and the release valve 141 will remain open until the ventilator 100 cycles to the positive pressure side, and when the spring-mechanism 143 will automatically close the same.

A pressure hose 118 from inside the patient chamber 101 feeds information to the pressure sensor/solenoid switch 138. Once the desired negative pressure is reached within the chamber 101, the pressure sensor/solenoid switch 138 activates a solenoid valve 145 preventing further negative pressure increases within the chamber 101, while a separate check-valve 146 maintains the existing negative pressure within the chamber 101. An adjustment of the pressure sensor knob on the pressure sensor/solenoid switch 138 allows for the modification of the desired chamber pressure.

Another handle adjustment 110 involves a long pin through a hollow portion of the adjustable secondary drive shaft 128. This arrangement employs a lock-and-key design to fit into a rod within the shaft 128 that, when engaged, will rotate a gear inside a 90° gear box 147. This adjusts the "throw" of the piston operating arm 137. The piston operating arm 137 has two components, a stationary portion welded to the secondary drive shaft 128 and a sliding, adjustable portion lengthening the arm 137 when desired. The lock-and-key system can be engaged and turned to rotate a gear within the 90° gear box 147, with the first gear contacting a second gear at an orientation of 90° to the original. A long, threaded rod 148 is attached to the second gear and in turn, secured to the adjustable portion of the piston operating arm 137. When the desired arm length is achieved, the operator disengages the handle 110 to ensure consistent "throw" of the piston rod 137. The larger the "throw", the further the piston rod 137 is pulled during the upswing of the arm 137. The piston rod 149 pulls the piston 172 within the vacuum cylinder 171 outwardly, thus creating a negative pressure within the cylinder 171. Adjusting the "throw" will simultaneously adjust both the maximum negative pressure and the time in which this maximum negative pressure is achieved.

The vacuum cylinder 171 is attached to a non-compressible hose 120, which is, in turn, sealed with a threaded lock 122 through a one-way "check" valve 173 to the inside of the patient chamber 101. When a negative pressure is created in the vacuum pipe 174, the atmospheric pressure within the chamber 101 is relatively higher, and thus the air molecules are forced out of the patient chamber 101, through the hose 120, and into the vacuum chamber 101, creating a negative intrathoracic pressure relative to the atmospheric pressure surrounding the entrance to the patients's airway (the nose and mouth which are explicitly located outside the vacuum chamber). The atmospheric air will then flow into the patient's airways, filling the lungs with the desired amount of gas. The one-way "check" valve 173 eliminates the return of any positive pressure into the patient chamber 101 itself.

By combining all of the above adjustments, any desired clinical response can be achieved with the inventive ventilator. A physician can calculate the fraction of inspired oxygen ($FiO_2$) required and place the patient on supplemental oxygen via nasal cannula, face mask, or tracheal tube, as required. The physician will then analyze the patient's physical response to the negative pressure, chest wall movements, oxygen saturations, end-tidal carbon dioxide levels, heart rate, respiratory rate and breathing function to evaluate the patient's clinical response and adjust settings as required.

Figure 29:
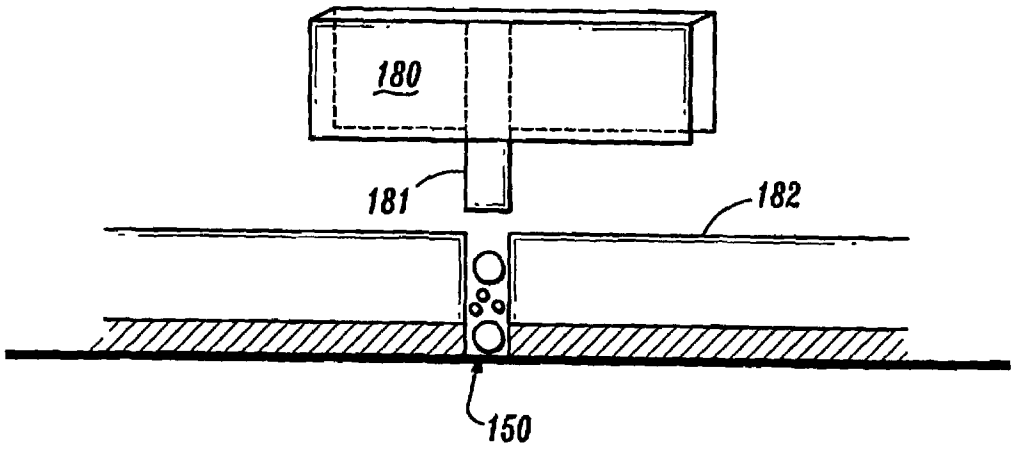
FIG. 29 schematically illustrates arrangement of an orifice through the chamber to receive tubing and wires and sealing of the orifice to maintain the vacuum within the chamber.

FIG. 29 illustrated a clamp 180 in the shape of an inverted "U" and having a flexible rubber protrusion 181 designed to mate with an edge of the threshold 182 adjacent to door 102, such that the tubes and wires 150 can securely pass into the vacuum chamber with the seal being maintained.

The preceding description of the present invention is merely exemplary and is not intended to limit the scope thereof in any way.

What is claimed is:

1. A ventilator, comprising a platform, a cover structured and arranged to be detachably coupled to said platform, a chamber defined by said cover and platform when coupled together and structured and arranged to encompass and aid breathing of a patient, tubing mounted about a lower edge of said cover, brackets mounted upon said platform and each comprising an opening, and pins structured and arranged to extend through said respective openings of said brackets and into ends of said tubing to thereby detachably couple said cover and platform together.

2. The ventilator of claim 1, which is transparent on all sides.

3. The ventilator of claim 1, comprising means for generating a vacuum within the chamber by a torque-conversion system.

4. The ventilator of claim 3, wherein said means include a wheel-and-belt configuration.

5. The ventilator of claim 3, wherein said cover comprises a panel situated between sections of said tubing and having a substantially U-shaped portal extending therethrough.

6. The ventilator of claim 5, additionally comprising a separate flexible shield having a portal of smaller dimension than said portal through said panel, and said separate shield arranged to be removably attachable to said panel.

7. The ventilator of claim 6, additionally comprising hook-and-loop fasteners on said panel and separate shield for removably attaching the same to one another.

8. The ventilator of claim 3, additionally comprising a portal extending through a top surface of said cover for coupling to said vacuum-generating means.

9. The ventilator of claim 1, comprising a door mounted to said chamber by a double-hinge mechanism.

10. The ventilator of claim 1, wherein the brackets are mounted on a top surface of said platform and each substantially L-shaped with an opening through each leg of said substantially L-shaped bracket, and said tubing is mounted upon said lower edge of said cover such that when said cover is placed and rests upon said platform, said tubing is situated between respective brackets affixed to the top surface of said platform.

11. The ventilator of claim 1, comprising four right-angled brackets mounted upon the top surface of said platform, with two brackets each mounted along a respective edge of the top surface of said platform and positioned such that sections of said tubing are each situated between said respective two brackets when said cover is placed and rests upon said platform.

12. The ventilator of claim 11, wherein said tubing is mounted upon an outer surface of the lower edge of said cover.

13. The ventilator of claim 12, additionally comprising braces wrapping around the outer and a top surface of said cover and securing the sections of said tubing to said cover.

14. The ventilator of claim 13, wherein said cover comprises a panel situated between the sections of said tubing and having a substantially U-shaped portal extending therethrough.

15. The ventilator of claim 14, additionally comprising a separate flexible shield having a portal of smaller dimension than said portal through said panel, and said separate shield arranged to be removably attachable to said panel.

16. The ventilator of claim 1, wherein said cover comprises a panel situated between sections of said tubing and having a substantially U-shaped portal extending therethrough.

17. The ventilator of claim 16, additionally comprising a separate flexible shield having a portal of smaller dimension than said portal through said panel, and said separate shield arranged to be removably attachable to said panel.

18. The ventilator of claim 17, additionally comprising hook-and-loop fasteners on said panel and separate shield for removably attaching the same to one another.

19. The ventilator of claim 1, wherein said platform is formed by a transparent panel secured to beams on all sides thereof and on which said brackets are mounted.

20. The ventilator of claim 19, wherein said cover is substantially rectangular-parallelepiped in shape with curved upper corners and an open bottom.

* * * * *